US006371223B2

(12) United States Patent
Wentworth et al.

(10) Patent No.: US 6,371,223 B2
(45) **Date of Patent: *Apr. 16, 2002**

(54) DRILL HEAD FOR DIRECTIONAL BORING

(75) Inventors: Steven W. Wentworth, Brookfield; Robert F. Crane, Oconomowoc, both of WI (US)

(73) Assignee: Earth Tool Company, L.L.C., Oconomowoc, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/517,688

(22) Filed: Mar. 2, 2000

Related U.S. Application Data

(60) Provisional application No. 60/122,508, filed on Mar. 3, 1999.

(51) Int. Cl.[7] ..... E21B 4/14
(52) U.S. Cl. ..... 175/296; 175/215; 173/135
(58) Field of Search ..... 175/61, 296, 215, 175/92, 93, 122, 203; 173/135, 16, 17, 131

(56) References Cited

U.S. PATENT DOCUMENTS

| | | | | |
|---|---|---|---|---|
| 3,791,463 A | | 2/1974 | Pearson | |
| 3,946,819 A | | 3/1976 | Hipp | |
| 3,978,931 A | | 9/1976 | Sudnishnikov et al. | |
| 4,084,646 A | | 4/1978 | Kurt | |
| 4,106,571 A | * | 8/1978 | Stone | 173/64 |
| 4,141,225 A | | 2/1979 | Varner | |
| 4,194,581 A | * | 3/1980 | Walter | 175/92 |
| 4,440,244 A | | 4/1984 | Wiredal | |
| 4,487,274 A | | 12/1984 | Hurt | |
| 4,530,408 A | | 7/1985 | Toutant | |
| 4,694,913 A | | 9/1987 | McDonald et al. | |
| 4,784,230 A | | 11/1988 | Cherrington et al. | |
| 4,819,746 A | * | 4/1989 | Brown et al. | 175/296 |
| 4,834,193 A | * | 5/1989 | Leitko, Jr. et al. | 175/19 |
| 4,867,255 A | | 9/1989 | Baker et al. | |

(List continued on next page.)

FOREIGN PATENT DOCUMENTS

| | | |
|---|---|---|
| JP | Hei6-56923 | 3/1994 |
| WO | WO 99/19596 | 4/1999 |

OTHER PUBLICATIONS

Geological Boring Advertisements for Sonde Housing: Duro Bore all soil bits; Duro Spade; Quick Steer; Bog–Hog Conical Steering Head; Sonde Housing Combination; and Back Reamer;, Vermeer–Illinois, Inc., 6 pages.

Spirol Coiled Pins brochure, Spirol International Corporation, Feb., 1997, 14 pages.

*Primary Examiner*—Frank Tsay
(74) *Attorney, Agent, or Firm*—Philip G. Meyers; Intellectual Property Law. P.C.

(57) ABSTRACT

A drill head for an apparatus for directional boring includes a bit having a cutting portion for use in steering, such as a gage tower mounted with carbide studs, suitable for cutting both hard and soft rock, a holder for a device for detecting angular orientation of the bit, and a pneumatic hammer connected head to tail with the bit at the front end. The valve in the hammer initiates reciprocation of the hammer in response to rearward movement of the bit, such as in response to a pushing force exerted by the drill string. The drill string components are preferably keyed to one another so that the orientation of the cutting portion of the bit used for steering is automatically matched to the position of the sonde. The sonde may project laterally so that its mass centroid is on the opposite side of the cutting portion of the bit used for steering to provide better cutting action. Such a drill head is suited for drilling in soil, soft rock and hard rock conditions.

24 Claims, 14 Drawing Sheets

U.S. PATENT DOCUMENTS

| | | | | |
|---|---|---|---|---|
| 4,907,658 | A | | 3/1990 | Stangl et al. |
| 4,945,999 | A | | 8/1990 | Malzahn |
| 4,953,638 | A | | 9/1990 | Dunn |
| 5,010,965 | A | | 4/1991 | Schmelzer |
| 5,052,503 | A | | 10/1991 | Lof |
| 5,070,948 | A | | 12/1991 | Malzahn et al. |
| RE33,793 | E | | 1/1992 | Cherrington et al. |
| 5,139,086 | A | | 8/1992 | Griffith, Sr. |
| 5,148,880 | A | | 9/1992 | Lee et al. |
| 5,205,363 | A | | 4/1993 | Pascale |
| 5,242,026 | A | | 9/1993 | Deken et al. |
| 5,253,721 | A | | 10/1993 | Lee |
| 5,566,771 | A | * | 10/1996 | Wolfer et al. ..... 175/296 |
| 5,633,589 | A | | 5/1997 | Mercer |
| 5,647,448 | A | | 7/1997 | Skaggs |
| 5,662,180 | A | * | 9/1997 | Coffman et al. ..... 175/57 |
| 5,778,991 | A | | 7/1998 | Runquist et al. |
| 5,795,991 | A | | 8/1998 | Hesse et al. |
| 5,799,740 | A | | 9/1998 | Stephenson et al. |
| 5,876,152 | A | | 3/1999 | Hesse |
| 5,899,283 | A | | 5/1999 | Cox |
| 6,148,935 | A | | 11/2000 | Wentworth et al. |

* cited by examiner

DRILL HEAD FOR DIRECTIONAL BORING

This application is a conversion of U.S. Provisional Application No. 60/122,508, filed Mar. 3, 1999, incorporated by reference herein and relied upon for priority.

TECHNICAL FIELD OF THE INVENTION

The invention relates to directional boring and, in particular to a system for boring through both soil, soft rock and hard rock using the same machine and specific assemblies for use in such a system.

BACKGROUND OF THE INVENTION

At present, when underground utilities such as natural gas, potable water, or sanitary sewer pipes are placed in rock, trenches are excavated using large hard rock trenching equipment such as the Vermeer T-655, or possibly even shot using explosives. In these conditions, electric, telephone and cable TV lines are normally strung overhead along poles, mostly due to the difficulty and expense of placing them underground. Thus, in many situations, a solid rock formation will cause utility lines to be located above ground due to the difficulty of underground installation. Many such sites involve mixed conditions involving both a solid rock formation for part of the run and soil for the remainder, often at the beginning and end of the run. In such a situation, rock drilling or trenching equipment may lack the capability to bore through the soil to reach the rock formation.

Directional boring apparatus for making holes through soil are well known. The directional borer generally includes a series of drill rods joined end to end to form a drill string. The drill string is pushed or pulled though the soil by means of a powerful hydraulic device such as a hydraulic cylinder. See Malzahn, U.S. Pat. Nos. 4,945,999 and 5,070,848, and Cherrington, U.S. Pat. No. 4,697,775 (RE 33,793). The drill string may be pushed and rotated and the same time as described in Dunn, U.S. Pat. No. 4,953,633 and Deken, et al., U.S. Pat. No. 5,242,026. A spade, bit or head configured for boring is disposed at the end of the drill string and may include an ejection nozzle for water to assist in boring.

In one variation of the traditional boring system, a series of drill string rods are used in combination with a percussion tool mounted at the end of the series of rods. The rods can supply a steady pushing force to the impact and the interior of the rods can be used to supply the pneumatic borer with compressed air. See McDonald et al. U.S. Pat. No. 4,694,913. This system has, however, found limited application commercially, perhaps because the drill string tends to buckle when used for pushing if the bore hole is substantially wider than the diameter of the drill string.

Accurate directional boring necessarily requires information regarding the orientation and depth of a cutting or boring tool, which almost inevitably requires that a sensor and transmitting device ("sonde") be attached to the cutting tool to prevent mis-boring and re-boring. One such device is described in U.S. Pat. No. 5,633,589, the disclosure of which is incorporated herein for all purposes. Baker U.S. Pat. No. 4,867,255 illustrates a steerable directional boring tool utilizing a pneumatic impactor.

Directional boring tools with rock drilling capability are described in Runquist U.S. Pat. No. 5,778,991 and in Cox European Patent Applications Nos. EP 857 852 A2 and EP 857 853 A2. However, although directional boring tools for both rock drilling and soil penetration are known, no prior art device has provided these capabilities in a single machine together with the ability to steer the tool in soil, soft rock and hard rock. Hard rock for purposes of the present invention means rock formations having a compressive strength of 18,000 psi or greater. Concrete typically has a compressive strength of around 8,000 and would be considered "soft rock" for this purpose, whereas granite may have a compressive strength of up to 80,000 psi. The present invention addresses this need.

U.S. Provisional Patent Application No. 60/122,593, filed Mar. 3, 1999 by a different inventive entity of which the present inventors are joint inventors, describes a drill head for an apparatus for directional boring including a starter rod, a holder for a device for detecting angular orientation such as a sonde, a pneumatic hammer and a rotary bit assembly connected head to tail with the starter rod at one end and the bit at the other. The bit has a frontwardly facing main cutting surface with a plurality of cutting teeth disposed thereon and a gage tower radially outwardly offset from the main cutting surface having at least one frontwardly facing gage cutting tooth thereon suitable for cutting over an angle defined by less than a full rotation of the bit. The device for detecting angular orientation is in a predetermined alignment with the gage tower so that it determines the orientation of the gage tower relative to the axis of rotation of the drill head. In one preferred embodiment, the main cutting surface is substantially flat and circular and has a series of fluid ejection ports thereon, and the drill head has passages for conducting a drill fluid therethrough to the ejection ports. In another preferred embodiment, the bit has a heel portion on an outer side surface thereof at a position opposite the gage tower, which heel portion slopes inwardly from back to front.

Such a drill head may be used in a method for directional boring using a directional boring machine which can push and rotate a drill string having the drill head mounted thereon. Such a method comprises the steps of boring straight through a medium by pushing and rotating the drill head with the drill string while delivering impacts to the bit with the hammer, prior to changing the boring direction, determining the angular orientation of the gage tower using the device for detecting angular orientation, and changing direction during boring by pushing and rotating the bit repeatedly over an angle defined by less than a full rotation of the bit while delivering impacts to the bit with the hammer, so that the drill head deviates in the direction of the cutting action of the gage tower. The medium may be soil, solid rock, or both at different times during the bore. In particular, the steps of boring straight and changing direction can be carried out in both soil and rock during the same boring run using the same bit.

According to a further aspect of the foregoing application, a method is provided for directional boring in mixed conditions including both soil and solid rock. Such a method includes the steps of boring straight in both soil and rock by pushing and rotating the drill head with the drill string while delivering impacts to the bit with the hammer, prior to changing the boring direction in both soil and rock, determining the angular orientation of the gage tower using the device for detecting angular orientation, changing direction when boring in rock by pushing and rotating the bit repeatedly over an angle defined by less than a full rotation of the bit while delivering impacts to the bit with the hammer, so that the drill head deviates in the direction of the cutting action of the gage tower, and changing direction when boring in soil by pushing the bit with the drill string without rotating it so that the drill head deviates in a direction of the gage tower and away from the heel portion. Since the main cutting face of the drill bit is large and flat, the pushing force of the drill string alone may be insufficient to steer the tool in soft ground without rotation. It is thus preferred to deliver impacts to the bit with the hammer while changing direction in soil. This method may provide better steering in some ground conditions.

SUMMARY OF THE INVENTION

The present invention provides a number of specific mechanical improvements to a drill head for carrying out the method of the foregoing provisional application. According to one aspect of the present invention, the bit has a gage tower oriented to the clock position of the sonde. This is done through a series of master splines or keyways that align the planes. The joints include sonde housing to body, body to front bushing, front bushing to bit shaft and bit shaft to bit. This alignment is key to any percussive hammer, fluid or pneumatic actuated, in it guarantees correct positioning of the gage tower relative to the sonde so that steering can be carried out with accuracy.

According to a second aspect of the invention, the bit is externally removable from the bit shaft. Changing the bit does not require disassembly of the hammer as all other down hole hammers do. Roll pins retain the bit to the bit shaft and an optional drive key may be interposed between the bit and bit shaft.

According to a third aspect of the invention, a splined connection is used to attach the sonde housing to both the starter rod and the sonde housing attachment to the hammer. The hammer may thereby be removed from the sonde housing and a rock drill head may be installed in its place should soft rock be encountered.

According to a fourth aspect of the invention, the front end cap and splined sleeve of the tool are clamp loaded using bolts, making tool disassembly easy compared to existing hammers. The use of a threaded connection between the sleeve and the impactor housing is permitted, but a front end cap is mounted by keying splines onto the impactor. Over- or under-tightening of the sleeve is avoided because one or more bolt holes in the cap will not align properly with bolt holes in the sleeve unless the sleeve is in the correct position relative to the sonde as described hereafter.

According to additional aspects of the invention, the tool has a unique start-up and shut down mechanism. An air passage connects the forward pressure chamber of the hammer to atmosphere out of the bit when frontal (thrust) pressure is removed, and a unique valving mechanism is provided which starts up when a predetermined forward thrust is exerted on the drill head by the drill string. The hammer expels air leaking past the striker to the rear chamber through clearance in the spline joint between the sonde housing and hammer, and the main valve is not secured to the hammer in any way. It floats in the recess at the front of the splined joint between sonde housing and hammer. The valve becomes trapped when the joint is pinned together.

According to a further aspect of the invention, the mass centroid of the hammer and sonde housing assembly is offset from the lengthwise axis of the head in a direction opposite to the direction the gage tower extends. Such an off center mass enhances the desired deflection of the hammer, thereby increasing the maximum rate of steer that can be achieved. The center of mass of the drill head can be most readily adjusted by offsetting the sonde housing and optionally the starter rod away from the gage tower to shift the center of mass of drill head in a favorable direction. The invention further contemplates an improved sonde housing which takes advantage of such offset to provide an improved air supply to the hammer.

A preferred form of fluid-powered impactor according to the invention for use in a drill head including a bit includes a tubular housing, a valve stem seated in the housing for receiving a supply of compressed fluid, the valve stem including a lengthwise passage ending in at least one radial port and a reduced diameter front end portion of the valve which extends forwardly from the radial port, a striker disposed for sliding movement within the housing, wherein a rear end opening in the striker receives the reduced diameter front end portion of the valve and forms a rear pressure chamber that receives pressure fluid from the port of the valve stem and exerts a force effective for propelling the striker forwardly, and a bit shaft slidably mounted in a bit shaft support assembly for movement between an extended position and a retracted position, which bit shaft has a front end on which the bit of the drill head is mounted in use, whereby separation between the housing and bit decreases as the bit shaft moves from its extended to its retracted position. Passages in the striker and valve stem configured so that: (i) when the bit shaft is in its extended position and the striker is in contact with a rear impact surface of the bit shaft, an air flow path is formed which permits compressed air from the rear pressure chamber to exhaust to the atmosphere; (ii) when the bit shaft is in its retracted position and the striker is in contact with a rear impact surface of the bit shaft, an air flow path is formed which permits compressed air from the rear pressure chamber to flow into a front pressure chamber ahead of the striker and thereby cause the striker to move rearwardly; and (iii) when the bit shaft is in its retracted position and the striker is moving rearwardly, the front pressure chamber exhausts to the atmosphere and pressure in the rear pressure chamber causes the striker to reverse direction and deliver a forward impact to the bit shaft. Operation of the hammer occurs in (ii) when a rearward pushing force exerted on the housing while the bit shaft is held from forward movement is sufficient to cause the bit shaft to assume its retracted position against the force exerted in the rear pressure chamber. The bit shaft preferably has a lengthwise bore through which exhaust can flow to the front end of the bit shaft and hence out through passages in the bit.

A drill head for an apparatus for directional boring according to another aspect of the invention includes a bit configured for directional boring, which bit can be steered by cutting over a limited arc of rotation with a predetermined cutting surface of the bit, a holder for a device for detecting angular orientation of the bit, including a key that permits mounting of the device in a predetermined position, a hammer positioned to deliver impacts to the bit, wherein the hammer, holder and bit are connected in series head to tail to form the drill head, and a connection suitable for mounting the drill head to a drill string, e.g., threads or a splined connection as described hereafter. A series of keying connections between the holder, hammer and bit key the angular orientation of the cutting surface of the bit to the angular orientation of the key of the holder, such that each connection fits together only when its angular orientation is keyed to (in a predetermined alignment with) the key of the holder. Preferably the keying connections comprise a plurality of spline and groove connections between each of the components.

The invention further provides a tubular housing configured for use in a drill head for an apparatus for directional boring for housing a device such as an impactor. The housing has a front end portion configured to form a first keying connection at a front end thereof and a second end portion configured to form a first keying connection at a rear end thereof. The first and second keying connections comprise a plurality of longitudinal spline and groove connections, such that the housing has one or the other (splines or grooves) at each end for coupling with adjacent drill head components.

A rock drilling bit assembly according to the invention includes a drill bit including a bit body, a front drilling surface having a plurality of cutting teeth extending therefrom, a rearwardly opening recess, and a transverse hole intersecting the rearwardly opening recess, and a bit shaft having a front end portion configured for a close fit into the recess of the drill bit and having an outwardly opening transverse groove which comes into alignment with the transverse hole in the drill bit for receiving a retainer therein. As noted below, such a bit may be interchanged as needed with a soil bit lacking teeth suited for rock drilling but with a sloped front face suitable for rapid steering in soil. In a preferred embodiment, the bit shaft has an enlarged diameter rear portion configured for sliding, sealing engagement inside of a tubular sleeve or tool housing and a series of external, longitudinal splines thereon ahead of the rear portion and configured for sliding engagement with grooves in the member (sleeve or tool housing) in which the bit shaft is mounted. For keying purposes, one of the bit shaft splines is preferably a master spline having a different size (such as circumferential width) that at least one other spline.

A drill head for an apparatus for directional boring according to another aspect of the invention includes a bit configured for directional boring, which bit can be steered by cutting over a limited arc of rotation with a predetermined cutting surface of the bit, a holder for a device for detecting angular orientation of the bit, including a key that permits mounting of the device in a predetermined position, a hammer positioned to deliver impacts to the bit, wherein the hammer, holder and bit are connected in series head to tail to form the drill head, a connection suitable for mounting the drill head to a drill string, and a series of connections between the holder, hammer and bit which key the angular orientation of the predetermined cutting surface of the bit to the angular orientation of the key of the holder. The mass centroid of this drill bit is located on an opposite side of a lengthwise axis of the drill head from the predetermined cutting surface of the bit. Alternately, the mass centroid is on the opposite side from the predetermined cutting surface or gage tower of a plane bisecting the drill head in a widthwise direction and passing through its longitudinal axis. This placement provides better drilling action to the bit as explained below.

The invention further provides an improved sonde holder for use in a drill head including at least a bit, the sonde housing and a connection at a rear end of the drill bit for connecting the drill head to a drill string, with or without a starter rod or impactor. The sonde holder includes a cylindrical housing having front and rear end connecting portions configured for coupling the sonde holder into the drill head assembly, which front and rear connecting portions are in alignment with a longitudinal axis of the sonde housing which coincides with a longitudinal axis of the drill head. A flow passage is provided through the housing for passing compressed fluid from rear to front in the sonde holder, and a sonde compartment is provided therein suitable for containing a sonde in a keyed position, which compartment is isolated from the flow passage and laterally offset therefrom. The cylindrical housing including a portion thereof defining the sonde compartment projects laterally from the longitudinal axis of the sonde housing which coincides with the longitudinal axis of the drill head, whereby the mass centroid of the sonde holder is offset from the a longitudinal axis of the sonde housing which coincides with the longitudinal axis of the drill head. A removable cover may be provided for accessing the sonde compartment, which cover is laterally offset from the longitudinal axis of the sonde housing which coincides with the longitudinal axis of the drill head and thereby contributes to the offset of the mass centroid of the sonde holder.

The invention also provides a substitute bit for use in with the foregoing drill heads of the invention for use when more rapid boring through soil is desired. The soil bit comprises a bit body having a frontwardly facing sloped face that defines an acute included angle relative to a lengthwise axis of the bit and configured for steering the bit through dirt when a pushing force is applied to the bit without rotating the bit. The bit further has a rearwardly opening recess for mounting the bit onto a bit shaft, at least one transverse hole intersecting the rearwardly opening recess and configured for insertion of a retaining pin therein which can mechanically interlock the bit to the bit shaft, and a fluid passage configured to carry pressure fluid from the recess to a location away from a front end of the bit.

These and other aspects of the invention are described in the detail description that follows.

BRIEF DESCRIPTION OF THE DRAWINGS

In the accompanying drawings, like numerals represent like elements except where section lines are indicated.

DETAILED DESCRIPTION OF THE INVENTION

Figure 1:
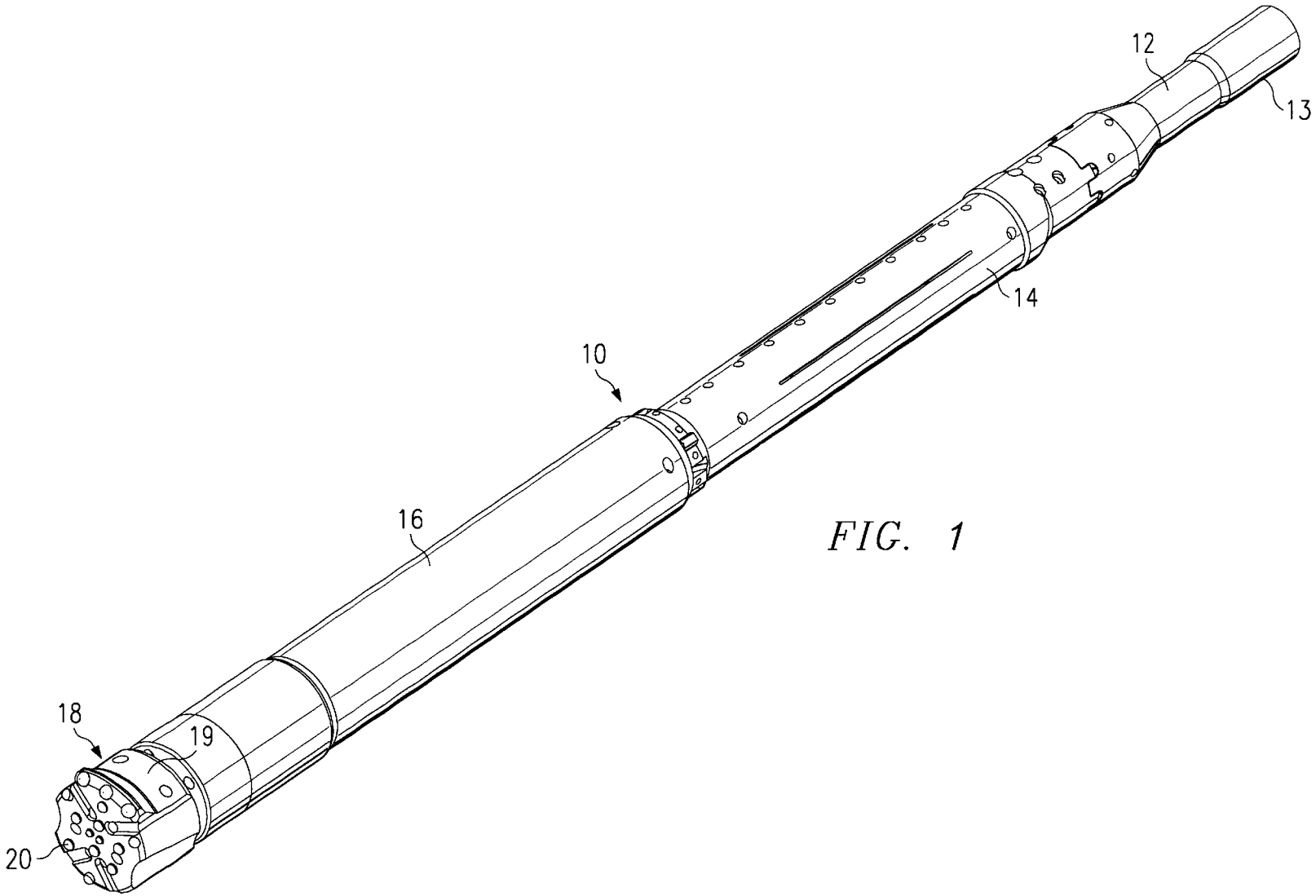
FIG. 1 is perspective view of a drill head according to the invention.

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention and are not to delimit the scope of the invention.

A drill head of the invention for use with an apparatus for directional boring includes a bit having a cutting portion for use in steering, such as a gage tower mounted with carbide studs, suitable for cutting both hard and soft rock. The drill head further includes a holder for a device for detecting angular orientation of the bit, such as a sonde, and a pneumatic hammer all connected head to tail with the bit at the front end. The valve in the hammer initiates reciprocation of the hammer in response to rearward movement of the bit, such as in response to a pushing force exerted by the drill string. The drill string components are preferably keyed to one another so that the orientation of the cutting portion of the bit used for steering is automatically matched to the position of the sonde. The sonde may project laterally so that its mass centroid is on the opposite side of the cutting portion of the bit used for steering to provide better cutting action. Such a drill head is suited for drilling in soil, soft rock and hard rock conditions as defined above.

Referring initially to FIGS. 1 through 20, a drill head 10 according to the invention includes, as general components, a starter rod 12, sonde holder 14, an impactor such as a pneumatic hammer 16, and a bit assembly 18 connected head to tail as shown. Starter rod 12 connects at its rear end 13 to a conventional drill string driven by a directional boring machine, and compressed air is fed through the drill string, a passage 11 in starter rod 12 and a passage 34 in the sonde holder 14 to operate the hammer 16. Hammer 16 includes a tubular housing 17 in which a valve stem 42, striker 60, sleeve 76 and bit shaft 21 are mounted as described hereafter. Except where otherwise noted below, sonde holder 14 and starter rod 12 and the splined connections between the illustrated components are substantially as described in one or more of co-pending U.S. Ser. No. 09/212,042, filed Dec. 15, 1998, U.S. Ser. No. 09/373,395, filed Aug. 12, 1999 and PCT International Application No. US99/19331, filed Aug. 24, 1999, which applications are incorporated by reference herein for all purposes.

Figure 45:
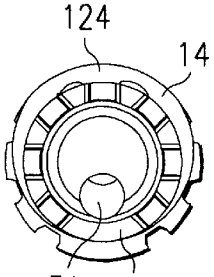
FIG. 45 is a rear end view of the sonde housing shown in FIG. 38.
Figure 44:
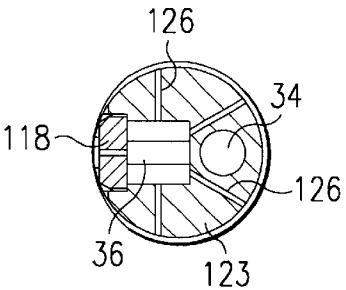
FIG. 44 is a cross sectional view taken along the line 44–44 in FIG. 39.
Figure 43:
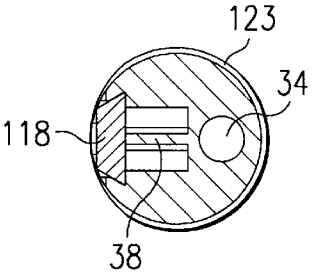
FIG. 43 is a cross sectional view taken along the line 43—43 in FIG. 39.
Figure 42:
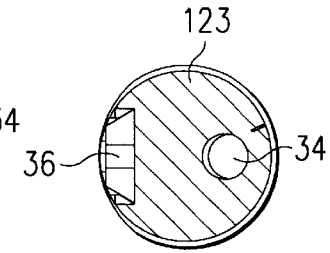
FIG. 42 is a cross sectional view taken along the line 42—42 in FIG. 39.
Figure 41:
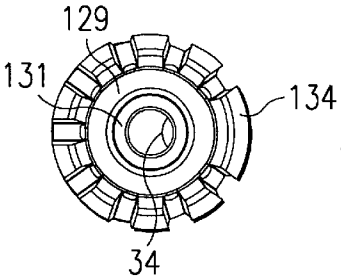
FIG. 41 is a front end view of the sonde housing shown in FIG. 38.

Starter rod 12, sonde holder 14 and pneumatic hammer 16 may be of types already known in the art. Hammer 16 may, for example, be an Ingersoll-Rand downhole or Halco hammer instead of the one shown. Splined connections of the type described in co-pending U.S. patent application Ser. No. 09/212,042, filed Dec. 15, 1998 are used to connect sonde holder 14 at either end to hammer 16 and starter rod 12. For this purpose, starter rod 12 has a projection 108 through which passage 11 becomes longer and narrower (to retain a suitable cross section for maintaining air flow) as it passes between holes 109 use to mount the roll pins or other retainers (see FIGS. 2B, 2D). Both starter rod 12 and sonde holder 14 may have a number of externally opening holes 110 into which carbide buttons (not shown) known in the art may be inserted to protect the base metal. Splines 111 of rod 12, which are located in an annular (circular) formation outside of projection 108, fit into corresponding grooves 112 at the rear end of sonde holder 14. A master spline and groove combination is provided to key the position of sonde holder to the known rotated position of the drill string (see master groove 113, FIG. 45). For purposes of the present invention, a master spline and groove may be either larger or smaller in width than the other splines, so long as it provides the desired keying function.

Figure 2A:
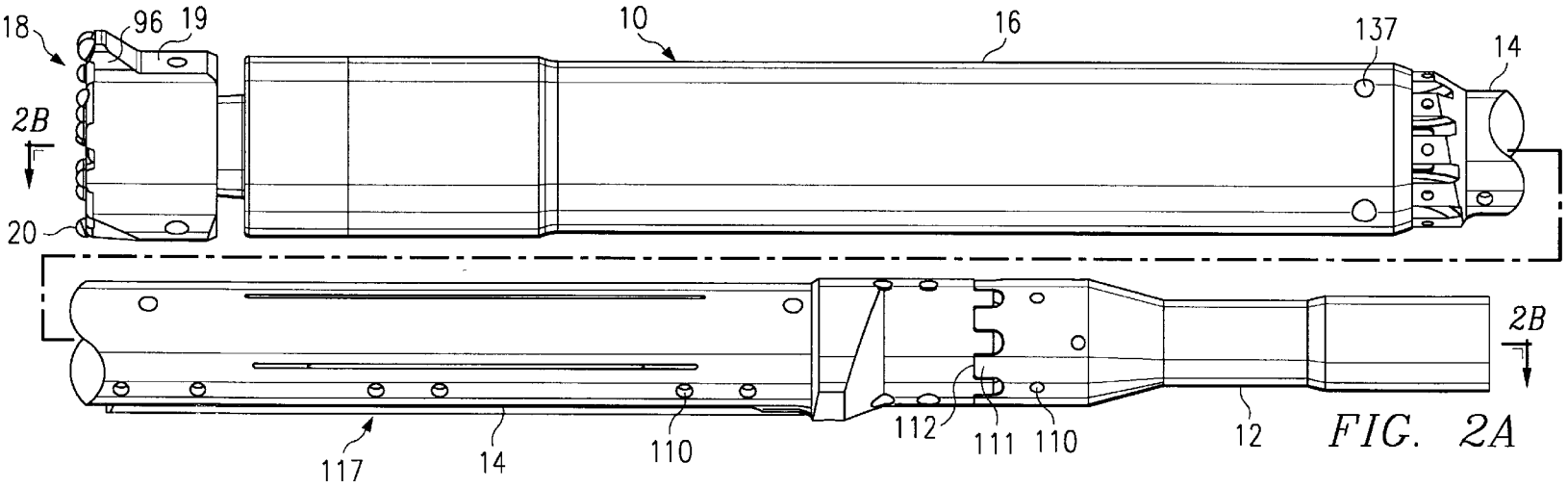
FIG. 2A is a side view of the drill head of FIG. 1.
Figure 2B:
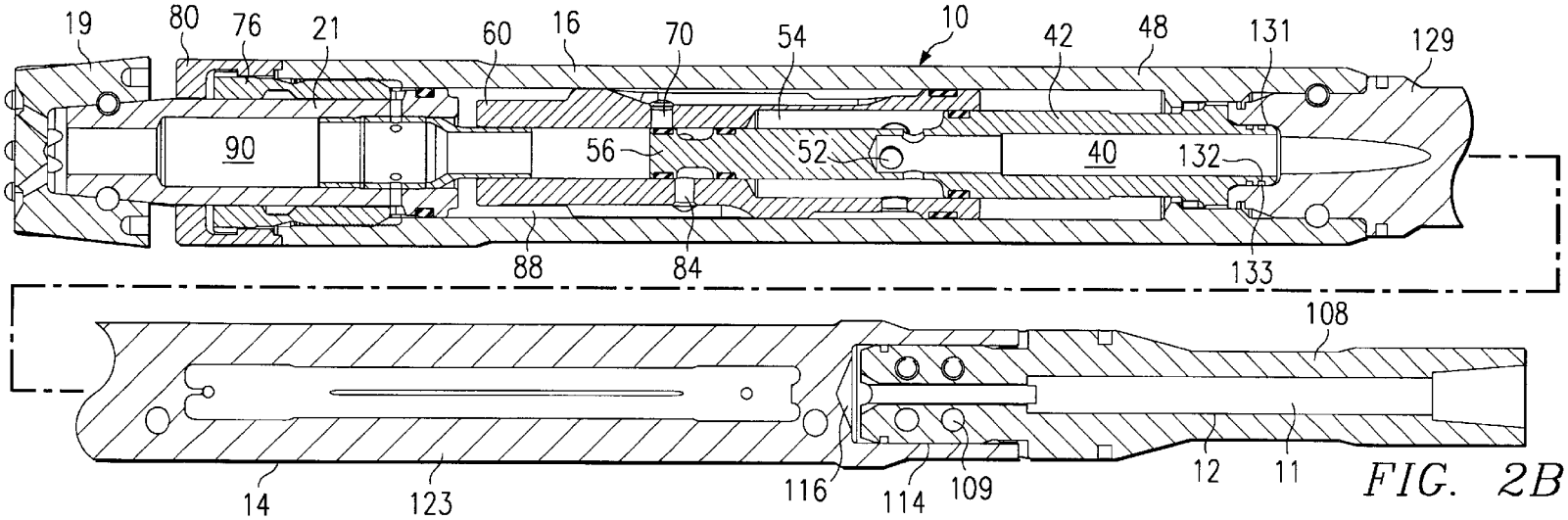
FIG. 2B is a lengthwise sectional view along the line 2B—2B in FIG. 2A.
Figures 2C, 2D:
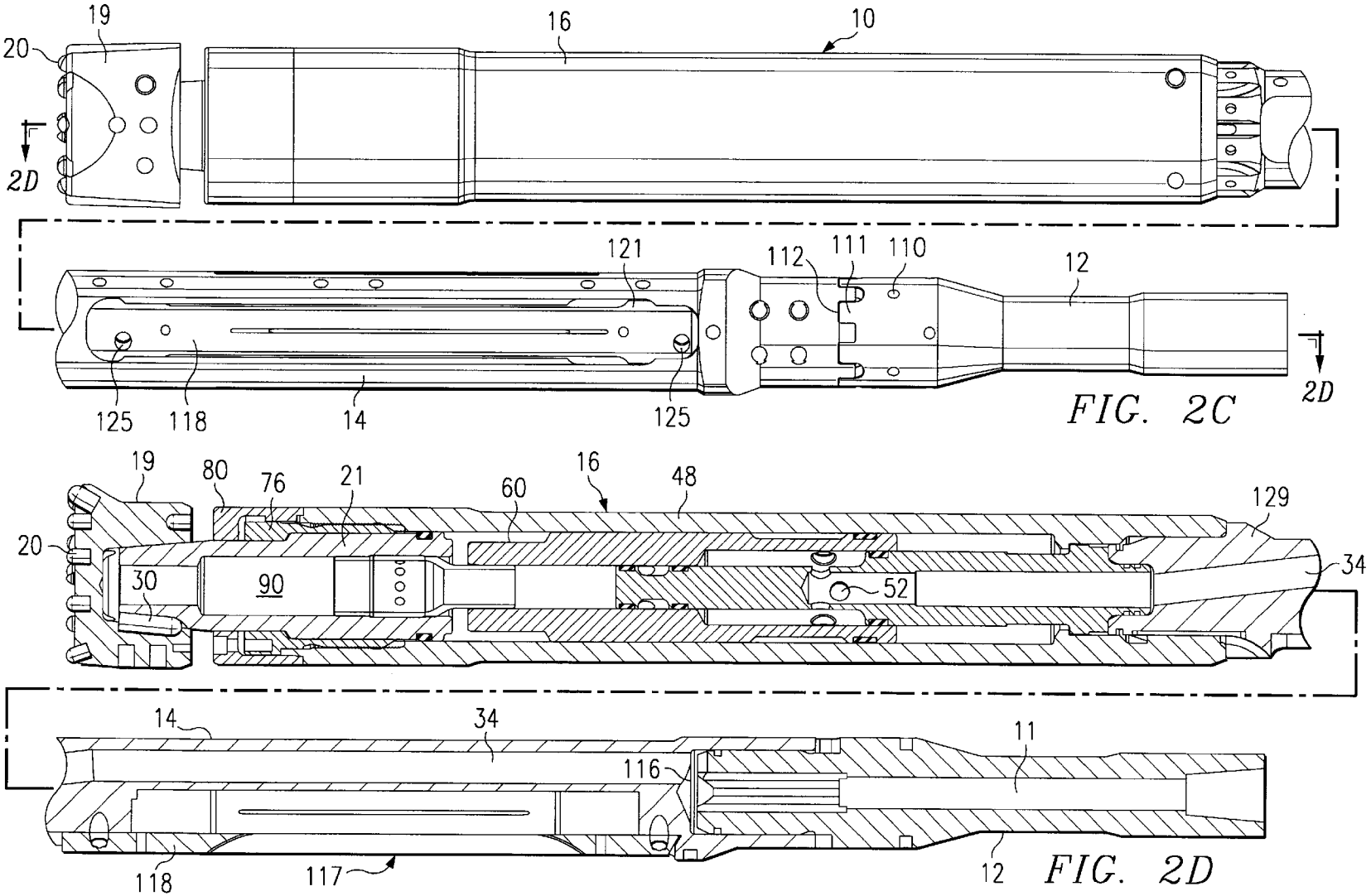
FIG. 2C is a bottom view of the drill head of FIG. 1.
FIG. 2D is a lengthwise sectional view along the line 2DB–2D in FIG. 2C.
Figure 3:
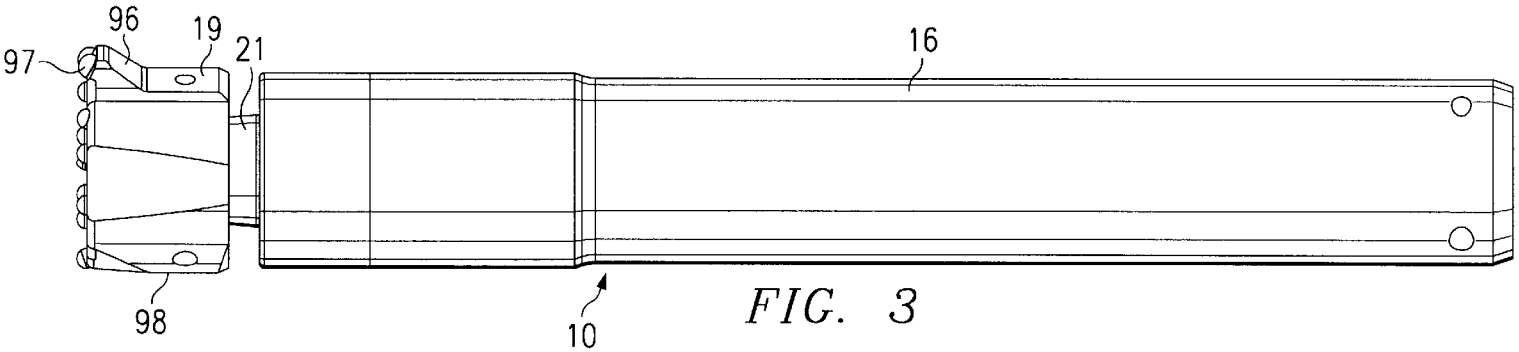
FIG. 3 is a side view of the bit assembly and impactor shown in FIGS. 1 and 2.

Referring to FIGS. 2A–2D and 38–45, sonde holder 14 is substantially the same as described in the above referenced applications but with certain differences. Junction 116 at which passages 11 and 34 meet when projection 108 is inserted into socket 114 in sonde holder 14 is widened to permit better air flow. Passage 34 is widened to provide a better supply of air for the impact hammer than would be needed for a rock drill that uses fluid only for lubrication. Since passage 34 must be isolated from the sonde compartment 36, compartment 36 is offset laterally, resulting in a sonde housing having a center of mass that is significantly offset from its central axis. This offset is preferably on the side of the tool opposite the gage tower 96 of bit described hereafter, as shown in FIG. 2A. As gage tower 96 cuts with its carbide gage cutters 97, the drill head 10 can brace itself against the wall of the hole at the protruding side 117. A laterally projecting brow or shoulder 124 forming part of generally cylindrical sonde housing 123 that extends in the direction opposite gage tower 96 helps serve this purpose.

The sonde is mounted in accordance with conventional practice in a predetermined orientation relative to the bit, e.g., by fitting an end of the sonde to a small key 38. Shock absorbers may be provided at opposite ends of the sonde compartment to isolate the sonde from vibrations and shocks. A cover 118 is removably secured by means of lateral wings 121 and retainers such as roll pins set in angled holes 125 as described in the foregoing applications incorporated by reference herein. Cover 118 as well as the adjoining part of generally cylindrical sonde housing 123 contributes to the overall shift in the center of mass of sonde holder 14. Radial slits 126 are provided in both housing 123 and cover 118 to permit the sonde signal to pass through the steel body of holder 14.

A splined front end projection 129 of sonde holder 14 that is secured in grooved socket 128 of air hammer 16 is nearly the same as its counterpart in the foregoing applications incorporated by reference herein used to mount a rock drilling bit directly to the front end of the sonde housing. In this instance, however, splined projection 129 must not only pass torque and provide sonde keying, but must also pass a larger quantity of highly pressured fluid (compressed air, mud, etc.) that powers the impact hammer. As such, projection 129 has a smaller diameter coupling socket 131 opening on its front face, which socket 131 communicates with passage 34. A rearwardly extending valve stem 42 of the hammer 16 has a tubular coupling projection 132 which preferably has a pair of sealing rings (not shown) set into annular grooves 133. Projection 132 fits into socket 131 forming a seal that prevents loss of pressure as the fluid for powering the hammer passes valve stem 42 to power the hammer as described hereafter. A master spline 134 received in a master groove 136 in the air hammer housing 48 assures that the air hammer is properly keyed to the sonde position. Transverse holes 137 in housing 48 that align with outwardly opening grooves 138 on projection 129 and complementary cutaways 139 on the inner surface of socket 128 receive roll pins or other removable retainers as described in the above-cited patent applications. A similar roll pin connection, omitting splines, is used to mount bit 19 onto bit shaft 21 as described hereafter.

Air impactor/hammer 16 operates in a unique manner so that impacts can be selectively applied to the bit during drilling without an elaborate control mechanism. This saves wear on the impactor in conditions where the tool is operating through soil to reach rock. For purposes of the invention a pneumatically powered hammer is preferred over a liquid powered hammer because of the large quantity of liquid the latter use and the low durability of such hammers in use.

Figure 4:
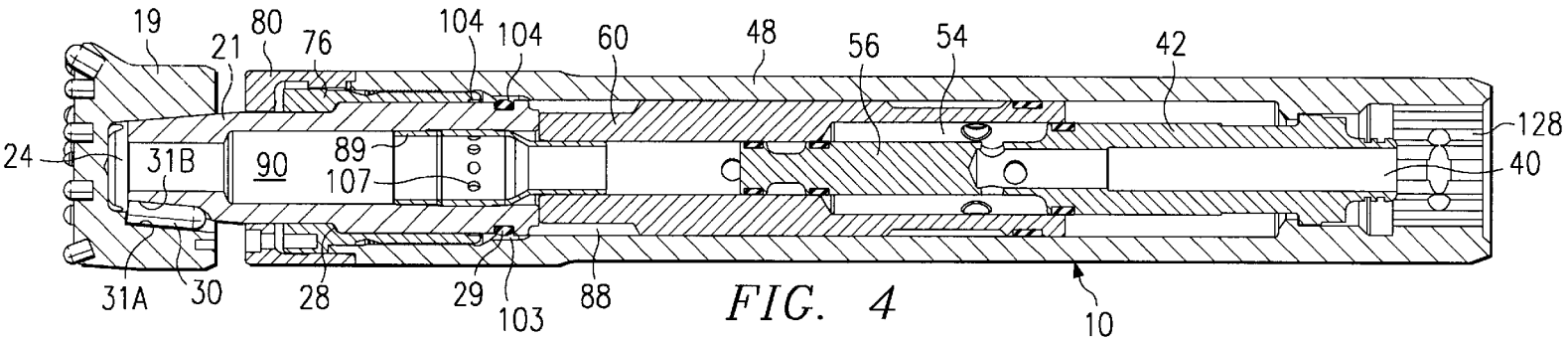
FIGS. 4 and 5 are lengthwise sections of the bit assembly and impactor shown in FIG. 3, with bit extended and the striker in its forwardmost position.
Figure 5:
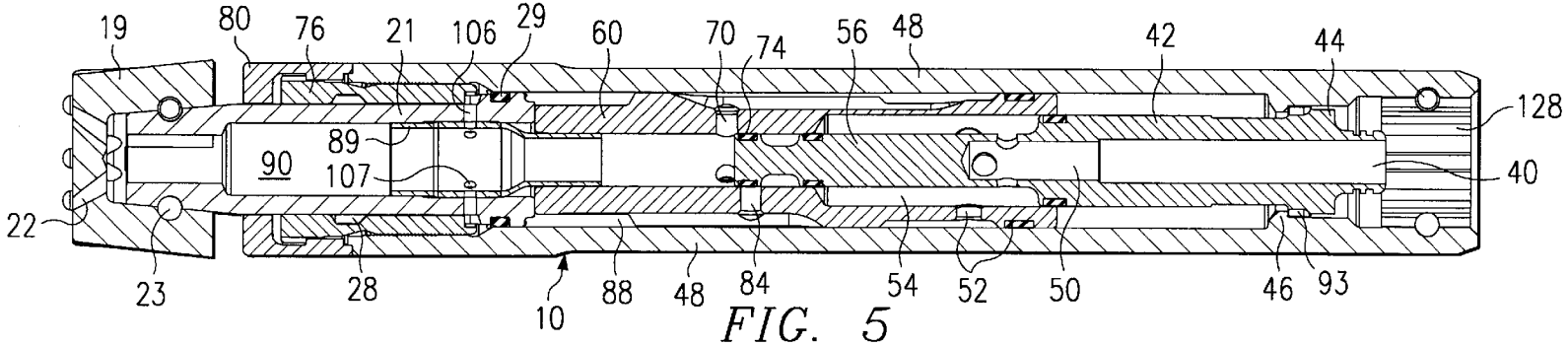
Figure 6:
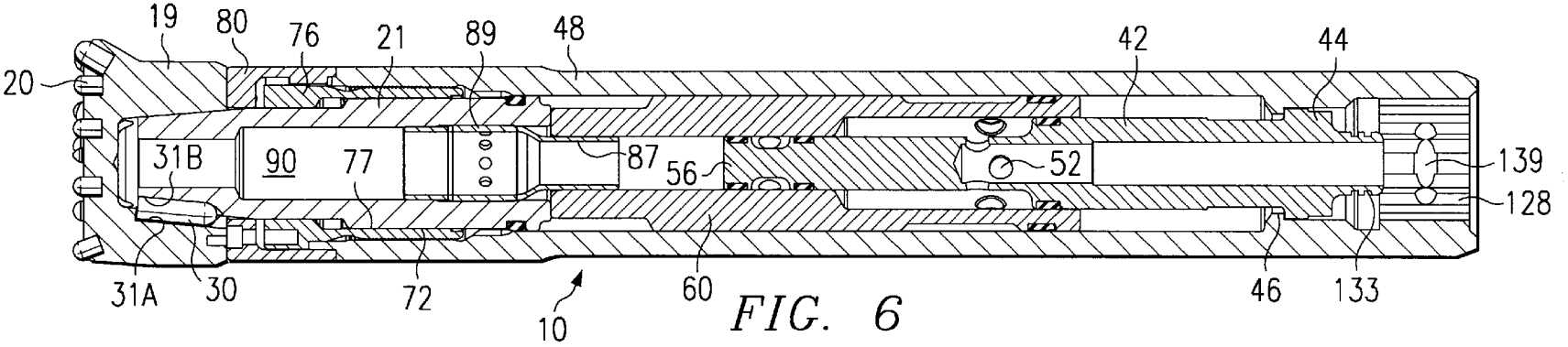
FIGS. 6 and 7 are lengthwise sections of the bit assembly and impactor shown in FIG. 3, with bit retracted and the striker in its forwardmost position.
Figure 7:
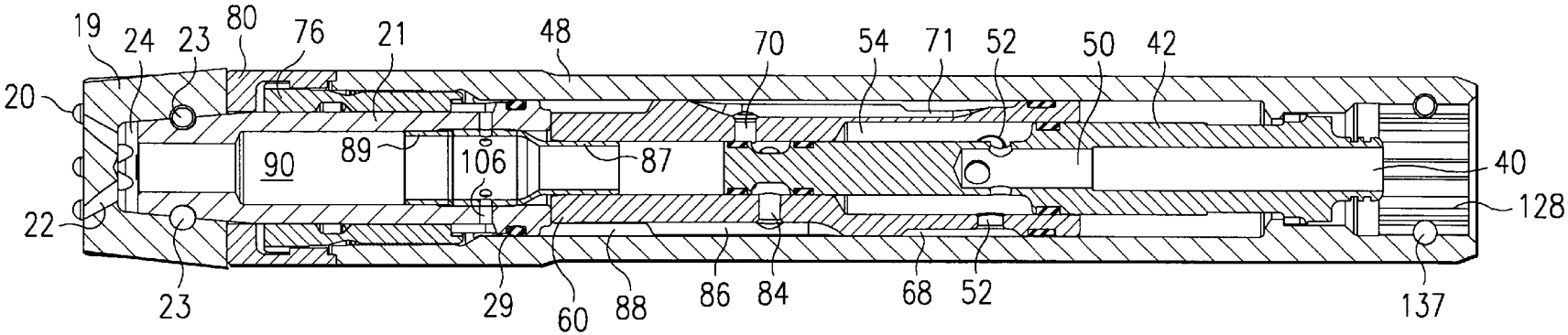

FIGS. 4 and 5 show drill head 10 just prior to start up with the chisel extended. Compressed fluid from the drill string flows along a central passage in starter rod 12 and passes in turn into a lengthwise passage 34 in sonde holder 14. The pressure fluid then passes out of the front end of passage 34 into a rear opening 40 in valve stem 42. A rear annular flange 44 of valve stem 42 is held in place between an inwardly extending annular flange 46 of a tubular housing 48 of hammer 16 and a front end face of sonde holder 14. Pressure fluid flows from opening 40 into a passage or manifold 50 having several radial ports 52, and then into an annular rear pressure chamber 54 formed between a reduced diameter front portion 56 of stem 42 and a rear tubular portion 58 of a striker 60. Pressure in this chamber urges striker 60 forwardly towards the position shown, wherein a front end of striker 60 delivers an impact to a rear anvil surface 62 of bit shaft 21.

Figure 8:
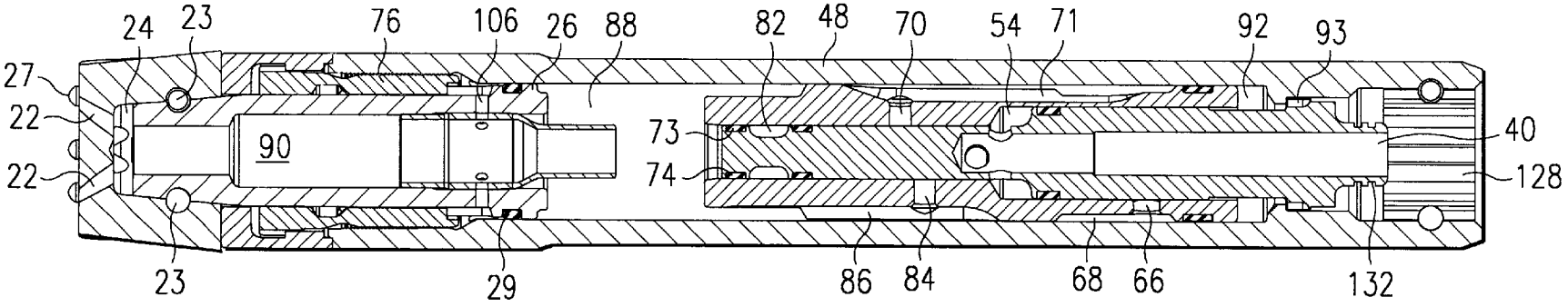
FIGS. 8 and 9 are lengthwise sections of the bit assembly and impactor shown in FIG. 3, with bit retracted and the striker in a rearward position.
Figure 22:
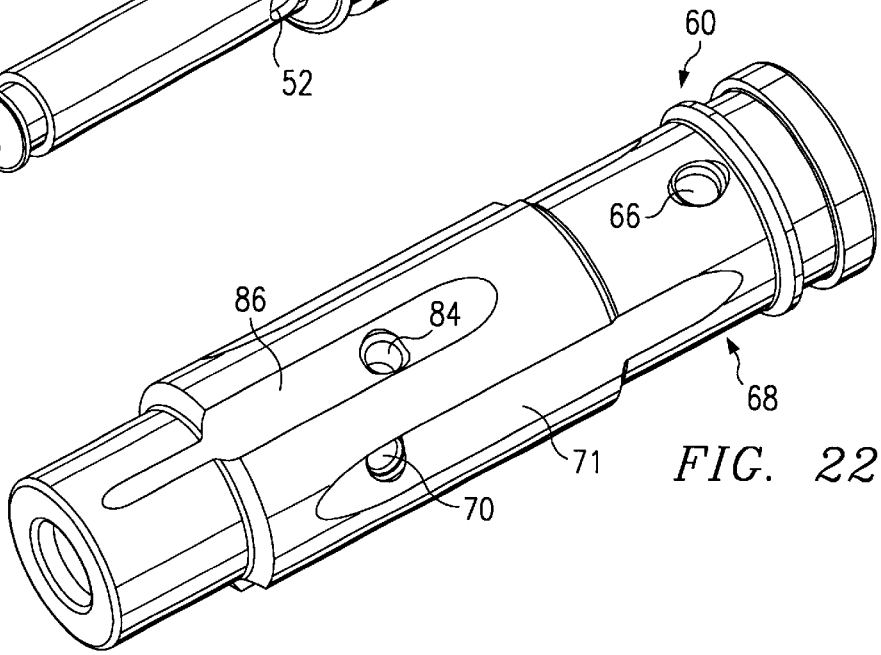
FIG. 22 is a perspective view of the striker of FIGS. 1–20.

Radial ports 66 provided through rear tubular portion 58 permit pressure fluid to flow into an outwardly opening annular groove 68 on the outside of rear portion 58. As shown in FIGS. 8 and 22, groove 68 communicates with a radially inwardly extending port 70 in striker 60 by means of a longitudinal groove 71. At this point, however, the flow of fluid depends on the position of striker 60 relative to valve stem 42. In this embodiment, when bit shaft 21 is in its extended position as shown in FIGS. 4 and 5, forwardmost three radial ports 70 are disposed ahead of a front surface 74 of reduced diameter portion 56 of striker 60, which in the illustrated embodiment mainly comprises the outer surface of a forward wear ring 73. This permits compressed air or other pressure fluid to flow into a bore 91 of striker 60, through the narrow, rear end 87 of a stepped plastic tube 89 and into bore 90 of the bit shaft 21. End 87 of tube 89 is in sliding engagement with the inner surface of striker bore 91, preventing air from escaping outwardly. The compressed air exhausts freely out the front of the tool through exhaust passages 22. In this position, a second trio of radial ports 84 set a short distance to the rear of ports 70 are covered by front surface 74 of reduced diameter portion 56 of striker 60, and thus striker 60 does not cycle. Constant pressure in chamber 54 holds striker in position against rear end impact surface 62 of bit shaft 21.

As the drill string exerts pressure on drill head 10 in the forward direction, such pressure overcomes the pressure fluid force in chamber 54 and bit shaft 21 and striker 60 move rearwardly, narrowing the gap between bit 19 and front end cap 80. As this occurs, port 70 moves rearwardly, becomes covered by front surface 74, and then becomes partially uncovered when it reaches an outwardly opening annular groove 82 in reduced diameter front portion 56 of stem 42. At this position, shown in FIGS. 6 and 7, compressed air flows from port 70, through groove 82, outwardly through second radial ports 84, and through a lengthwise elongated groove 86 in the outside of striker 60 to a front pressure chamber 88. At this point, striker 60 begins to move rearwardly due to the pressure in chamber 88, and a gap opens between striker 60 and rear anvil surface 62 of bit shaft 21A. However, narrow end 87 of stepped plastic tube 89 prevents compressed fluid from entering bore 90 in bit shaft 21.

Figure 9:
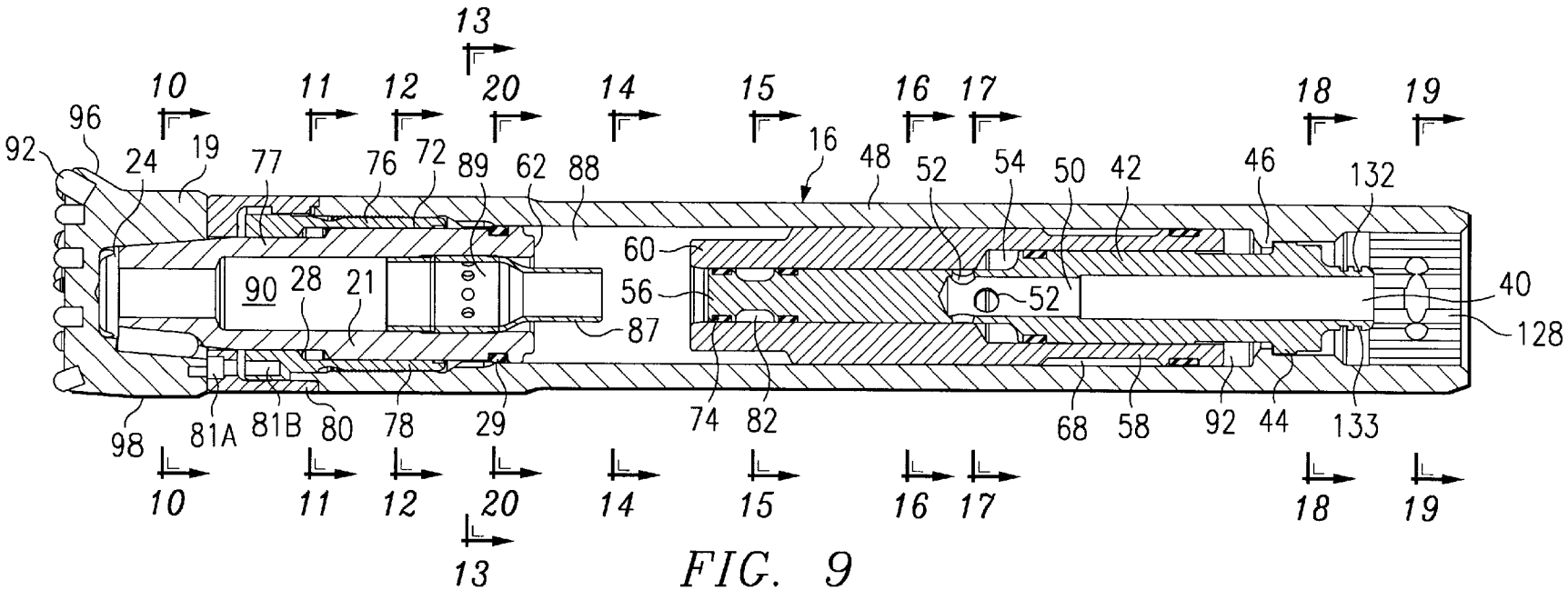
Figure 10:
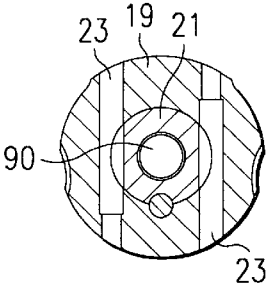
FIG. 10 is a cross-sectional view taken along the line 10—10 in FIGS. 8 and 9.
Figure 11:
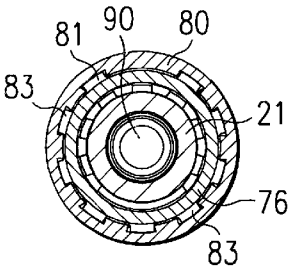
FIG. 11 is a cross-sectional view taken along the line 11—11 in FIGS. 8 and 9.
Figure 12:
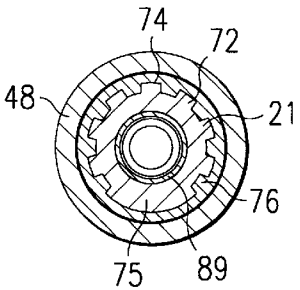
FIG. 12 is a cross-sectional view taken along the line 12—12 in FIGS. 8 and 9.
Figure 13:
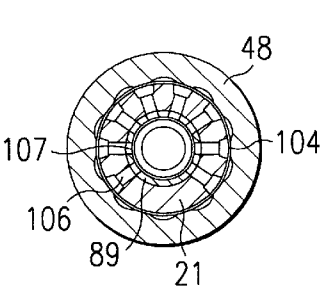
FIG. 13 is a cross-sectional view taken along the line 13—13 in FIGS. 8 and 9.
Figure 14:
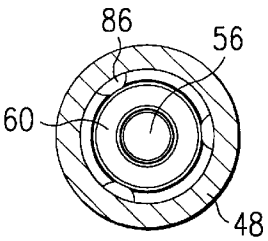
FIG. 14 is a cross-sectional view taken along the line 14—14 in FIGS. 8 and 9.
Figure 15:
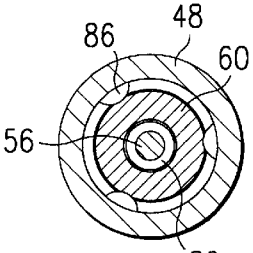
FIG. 15 is a cross-sectional view taken along the line 15—15 in FIGS. 8 and 9.
Figure 16:
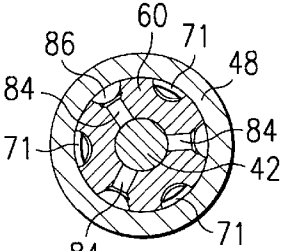
FIG. 16 is a cross-sectional view taken along the line 16—16 in FIGS. 8 and 9.
Figure 17:
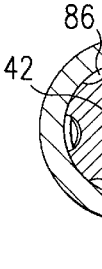
FIG. 17 is a cross-sectional view taken along the line 17—17 in FIGS. 8 and 9.
Figure 18:
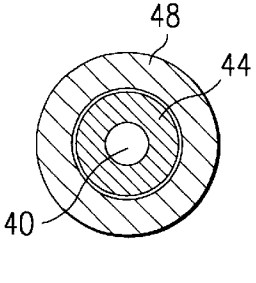
FIG. 18 is a cross-sectional view taken along the line 18—18 in FIGS. 8 and 9.
Figure 19:
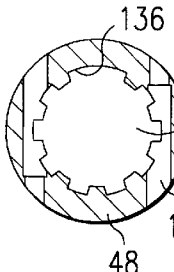
FIG. 19 is a cross-sectional view taken along the line 19—19 in FIGS. 8 and 9.
Figure 20:
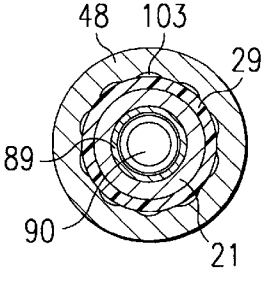
FIG. 20 is a cross-sectional view taken along the line 20—20 in FIGS. 8 and 9.
Figure 21:
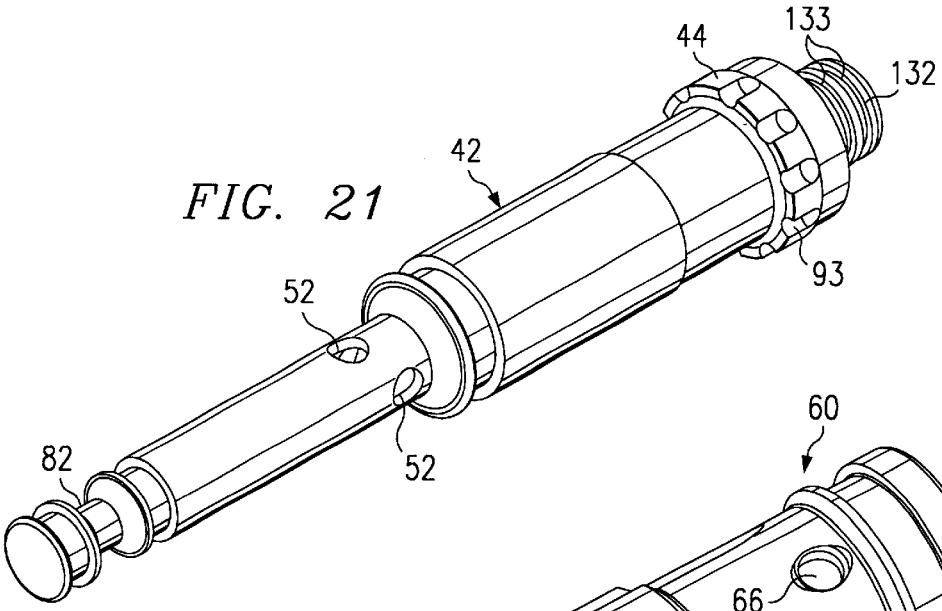
FIG. 21 is a perspective view of the valve stem of FIGS. 1–20.

As striker 60 continues its rearward stroke and moves to the position shown in FIGS. 8 and 9, ports 70, 84 become covered by front portion 56 of stem 42, cutting off the flow of compressed air from constant pressure chamber 54 and isolating forward pressure chamber 88. Striker 60 clears the rear end portion 87 of a plastic inner sleeve 89, permitting decompression of front chamber 88 through bore 90 and exhaust ports 22 located in bit 19. Pressure fluid is ejected into the hole from bit 19 and turns into foam. At this point, the force exerted in rear pressure chamber 54 slows striker 60 and reverses its direction to begin its forward stroke.

As the striker reaches the position shown in FIGS. 8 and 9, a chamber 92 to the rear of striker 60 is preferably vented through an annular formation of longitudinal grooves 93 between flange 44 and housing 48, then through a small annular space to the grooved socket 128 that receives the splined front end 127 of sonde holder 14. This prevents excess pressure build up in chamber 92. It will be noted that a front end projection 129 of sonde holder 14 has an annular groove 141 thereon that would appear to defeat this purpose if a sealing ring were placed therein as with the other such annular seal grooves described herein. In this instance, groove 141 is left empty and is provided mainly for permitting sonde holder 14 to be usable with other types of boring tools wherein a seal is needed between the sonde housing and the component ahead of it. Air hammer 16 thus operates continuously and starts automatically when a predetermined threshold of pushing force is applied through the drill sting.

Bit shaft 21 is generally cylindrical but has a series of evenly spaced, radial splines 72 along its midsection which are elongated in the lengthwise direction of shaft 21. Splines 72 fit closely and are slidably mounted in corresponding grooves 77 formed on the inside of a sleeve 76. Sleeve 76 is removably mounted in the front end of tubular housing 48, e.g., by means of external threads 78 and internal housing threads 69, and has a front end cap 80 secured thereto by bolts (not shown) set in aligned pairs of holes 81A, 81B (several of each).

Figure 23:
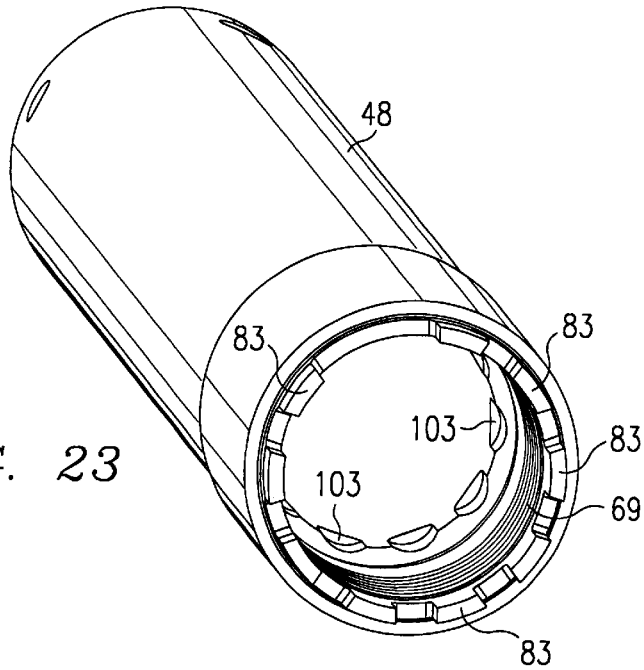
FIG. 23 is a front perspective view of the impactor housing of FIGS. 1–20.
Figure 24:
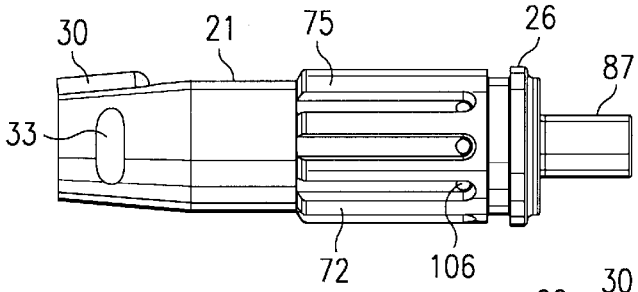
FIG. 24 is a side view of the bit shaft of FIGS. 1–20.
Figure 25:
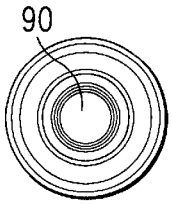
FIG. 25 is a rear end view of the bit shaft of FIG. 24.
Figure 26:
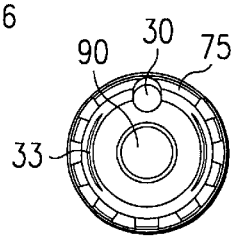
FIG. 26 is a front end view of the bit shaft of FIG. 24.
Figure 27:
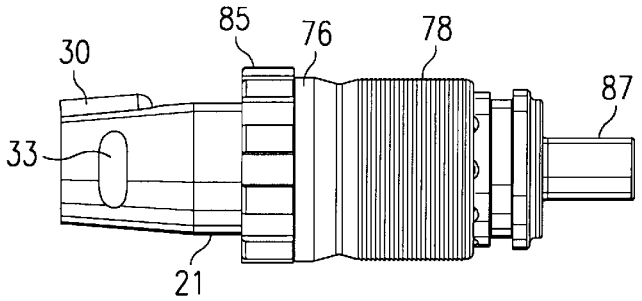
FIG. 27 is a side view of the bit shaft and sleeve of FIGS. 1–20.
Figure 28:
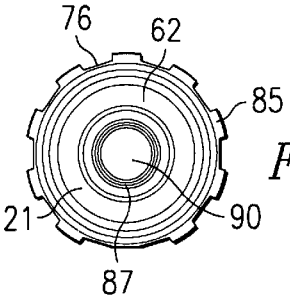
FIG. 28 is a rear end view of the bit shaft and sleeve of FIG. 27.
Figure 29:
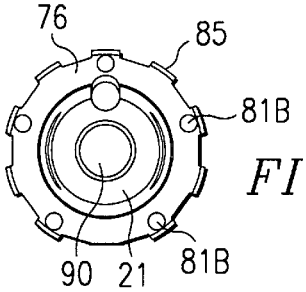
FIG. 29 is a front end view of the bit shaft and sleeve of FIG. 27.
Figure 30:
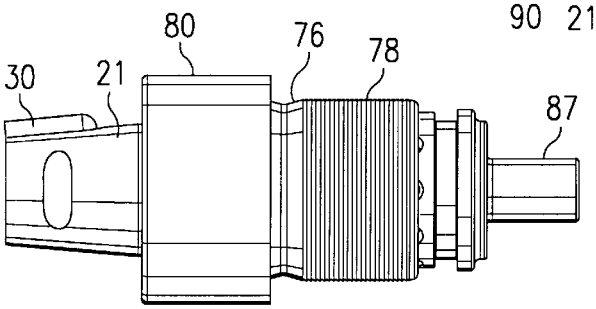
FIG. 30 is a side view of the bit shaft, sleeve and end cap of FIGS. 1–20.
Figure 31:
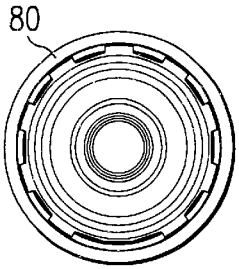
FIG. 31 is a rear end view of the bit shaft, sleeve and end cap of FIG. 30.
Figure 32:
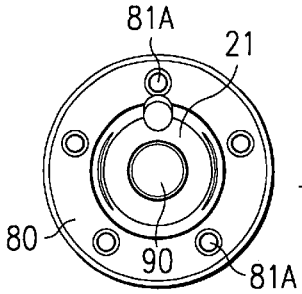
FIG. 32 is a front end view of the bit shaft, sleeve and end cap of FIG. 30.

Splines 72 include a master spline 75 of enhanced width that fits in a corresponding master groove 67 in sleeve 76. Master spline 75, in combination with the other keyed connections, ensures that bit 19 is properly aligned with the sonde for steering. Cap 80 in turn has a series of grooves 79 that engage an annular formation of tabs 83 that extend from the front of housing 48 together with an annular formation of external splines 85 on the outside of sleeve 76. Splines 85 coincide with tabs 83 and are set adjacent and ahead of tabs 83 in grooves 79. Splines 85 insure proper positioning of both sleeve 76 relative to cap 80. As shown in FIG. 23, one tab 83 and spline 85 in an otherwise evenly spaced series and its corresponding groove are absent, so that cap 80 can only fit onto housing 48 in one orientation, namely the one wherein holes 81A line up with holes 81B. This orientation of housing 48 is keyed to the position of the sonde by the keyed spline connections that connect sonde holder 14 to impactor housing 48. To ensure keying, the assembly of bit shaft 21 and sleeve 76 is mounted by screwing sleeve 76 in all the way, and then unscrewing it slightly until bolt holes 81A line up with sleeve holes 81B. In this manner, even though sleeve is mounted by means of threads 78, the bit shaft 21 and in turn the bit 19 mounted thereon are keyed to the position of the sonde with no possibility for installation error. This keying ultimately puts the gage tower 96 described hereafter and its opposing sloped face, if used, into a known relationship with the sonde for purposes of steering through rock.

Bit shaft 21 has an enlarged diameter rear end portion 26 that mounts a sealing ring 29 that slides along the inside of housing 48 and maintains a seal therewith. Bit shaft 21 slides inside of sleeve 76 between a forwardmost position at which front ends of splines 72 engage an inner annular step 28 of sleeve 76 and a rearwardmost position at which bit 19 engages front end cap 80. These positions define the operating cycle of the impactor.

According to further aspect of the invention, additional exhaust vents are provided which greatly facilitate stopping the hammer immediately when desired. In order to stop the hammer, drill string pressure is lightened cause bit shaft 21 to slide forwardly within sleeve 76. As this happens, the position of striker 60 at impact shifts forward, causing it to return to the position initially described wherein port 70 is ahead of surface 74 and exhausts through bore 90, and port 84 is covered by surface 74. This however does not always bring striker 60 to an immediate stop, primarily because of residual pressure in front pressure chamber 88 which is cut off when port 84 is closed.

To alleviate this pressure when the chisel is in its extended position, an annular formation of shallow lengthwise grooves 103 are formed on the inner surface of housing 48 near to where enlarged diameter rear end portion 26 of bit shaft 21 is positioned when installed. When the bit shaft is in its extended position as shown in FIG. 4, grooves 103 establish communication outside of end portion 26 to an annular space 104 between bit shaft 21 and the inside of housing 48. Compressed air entering space 104 flows inwardly through an annular formation of radial holes 106 in bit shaft 21 and a like number of holes 107 in plastic tube 89 and thereby exits the tool through bore 90 and passages 22. When bit shaft 21 is in its normal working position, rear end portion 26 is positioned rearwardly of the ends of grooves 103, and thus leakage from front chamber 88 is avoided. Such a system has been found highly effective for stopping striker 60, generally immediately once pressure on the drill string is lessened beneath the threshold level needed to run the impactor.

A further advantage of this mechanism is that several air flow modes are provided without complicated machining of passages in the body (housing 48). Many known tools use long passages through the tool housing as a means for carrying air to and/or from the front pressure chamber of the tool. By using a frontward exhaust and a mechanical system for depressurizing the front pressure chamber in response to a change in bit position, the present invention avoids the need to machine such passages.

Figure 34:
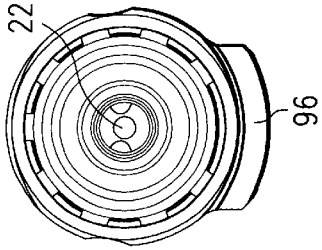
FIG. 34 is a rear end view of the bit shaft, sleeve, end cap and bit of FIG. 33.
Figure 37:
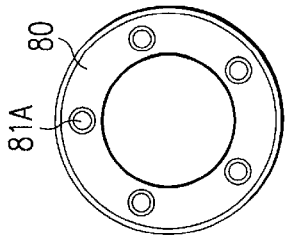
FIG. 37 is a front view of the end cap of FIG. 36.
Figure 36:
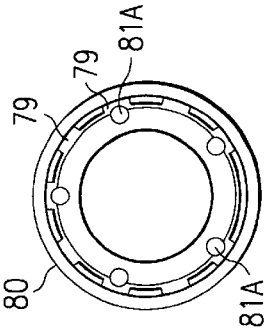
FIG. 36 is a rear view of the end cap of FIGS. 1–20, 30–35.
Figure 33:
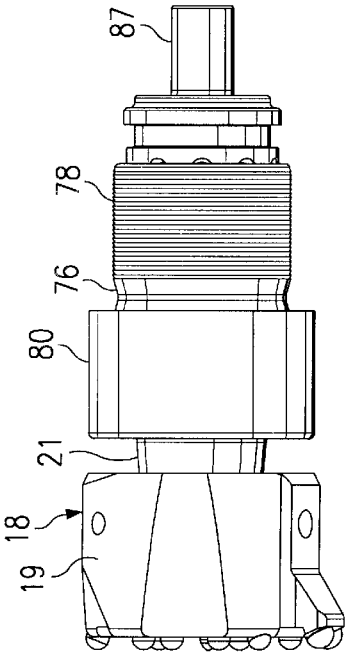
FIG. 33 is a side view of the bit shaft, sleeve, end cap and bit of FIGS. 1–20.
Figure 35:
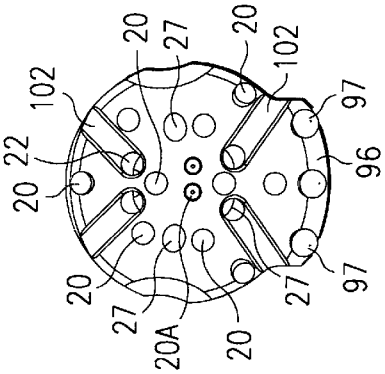
FIG. 35 is a front end view of the bit shaft, sleeve, end cap and bit of FIG. 33.
Figure 38:
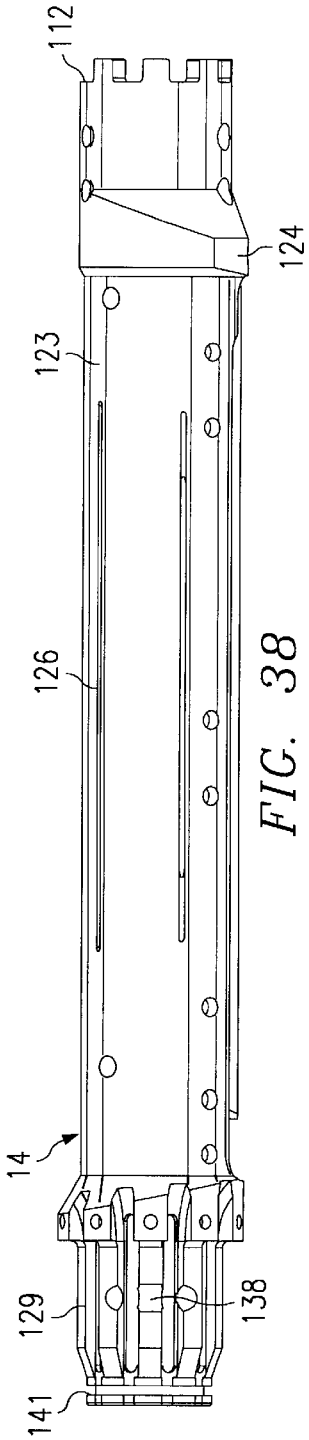
FIG. 38 is a side view of the sonde housing shown in FIG. 1.
Figure 39:
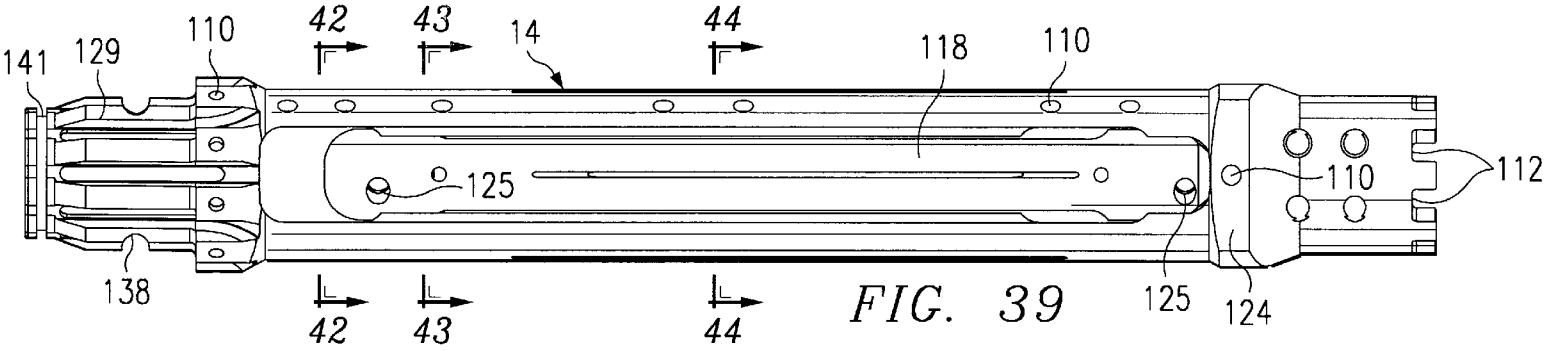
FIG. 39 is a top view of the sonde housing of FIG. 38.
Figure 40:
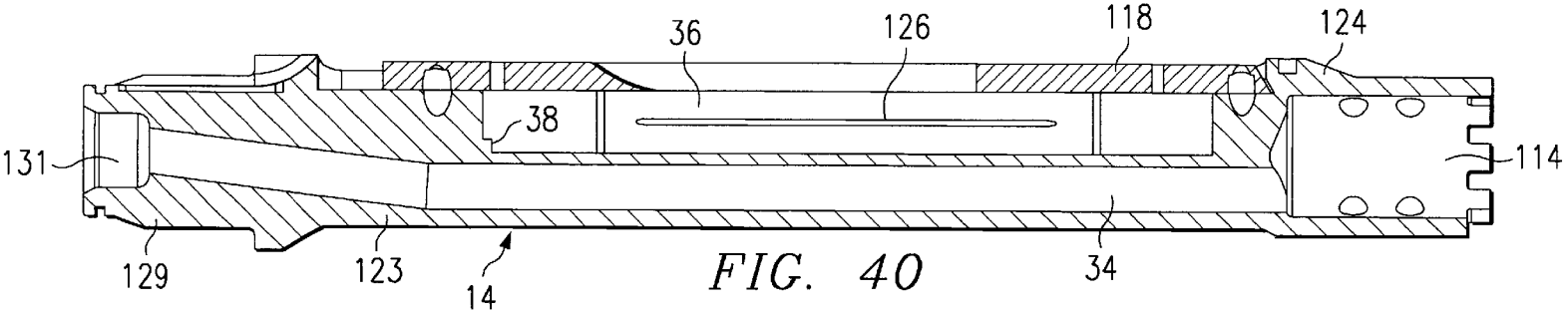
FIG. 40 is a lengthwise sectional view taken along the line 40—40 in FIG. 39.

Referring to FIGS. 33–35, bit assembly 18 includes a generally cylindrical bit 19 having an array of cutting teeth in the form of rounded tungsten carbide buttons 20, and a bit shaft 21 which is used to mount the bit 19 onto the front end of the hammer 16. Bit 19 is removably mounted to shaft 21 by means of roll pins inserted through transverse holes 23 and a pair of rounded, outwardly opening grooves 33 on a tapered front end portion of bit shaft 21 that fits closely (but removably) in a rearwardly opening recess 35 in bit 19. A bit shaft drive key 30 is seated in openings 31A, 31B in bit 19 and bit shaft 21, respectively, for assuring that bit 19 fits onto bit shaft 21 in the proper position relative to the sonde and the other keyed connections and provides additional drive torque.

Exhaust passages 22 are provided in bit assembly 18 for ejecting compressed air from hammer 16 out of the front of bit 19. Six passages 22 as shown diverge radially outwardly and forwardly from the bottom of a rearwardly opening recess 24 in bit 19 ending at ejection ports 27, which may optionally have shallow, radially outwardly extending grooves 102 (such as four or six such grooves) which aid in carrying material away from the bit. The exact placement of ports 27 is not essential, but a spread formation such as a circle with the ports clustered around the center of the front bit face is preferred. Compressed air from an air compressor is combined with a foam-forming agent so that a lubricating drilling foam forms spontaneously upon ejection/decompression from ports 27 of bit 19. This foam is used to carry away soil and/or rock chips from the bit's path.

Bit 19 has a radial extension or gage tower 96 that carries several gage cutters 97 which generally resemble the other carbide teeth or buttons 20. Preferably there are at least three gage cutters 97, e.g. one at the center of tower 96 and two others equally spaced from it, that define an arc, generally describing an imaginary circle larger than the outer circumference of bit 19. However, even a single cutter 97 may prove sufficient for some purposes, and thus the gage tower 96 need have no greater width than a single such cutter 97. However, it is preferred that the gage tower 96 define an angle A of from about 45 to 90 degrees relative to the lengthwise axis of the drill head 10, or having a length of from about ½ to ¼ of the width of bit 19. Gage cutters 97, like teeth 20, are most preferably tungsten carbide buttons. As the drawings show, the height of gage tower is approximately the same as or slightly greater than the diameter of the cutters 97.

Gage is a term that defines the diameter of the bore created by the bit 19. This diameter is the size scribed by a heel portion 98 on the opposite side of bit 19 from the gage tower and one or more gage cutters 97 if the bit is rotated a full revolution. The heel 98 functions as a bearing surface that provides a reaction force for the gage cutting action. A main cutting surface 99 having a number of spaced buttons 20 distributed thereon removes material from the central area of the bore in the same way a classic non-steerable percussion rock drill does, and may include one or more pointed carbides 20A.

Figure 48:
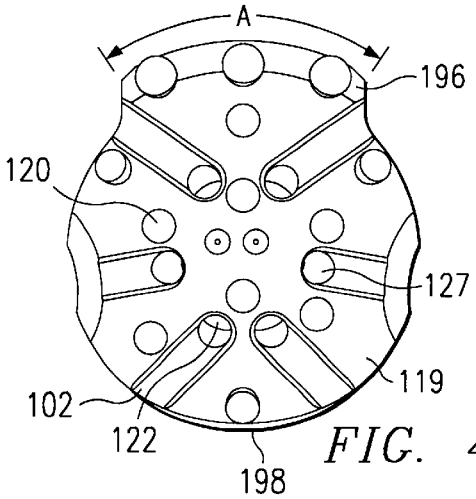
FIG. 48 is a front view of a fifth alternative bit according to the invention.
Figure 49:
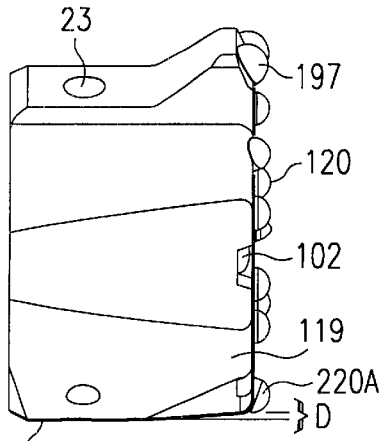
FIG. 49 is a side view of the bit of FIG. 18.
Figure 50:
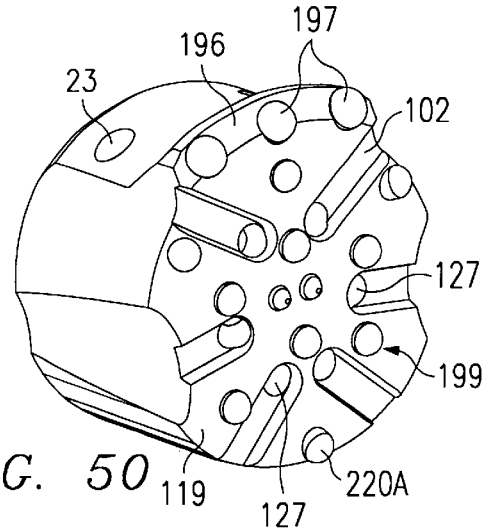
FIG. 50 is a perspective view of the bit of FIG. 18.
Figure 51:
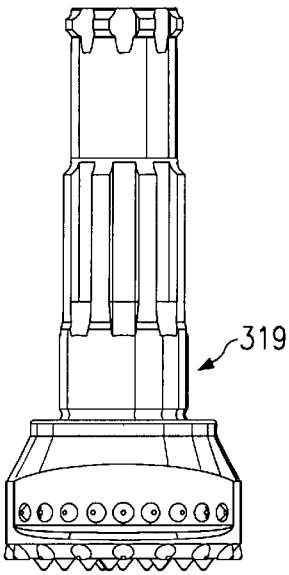
FIG. 51 is a top view of a second alternative bit and bit shaft assembly according to the invention.
Figure 52:
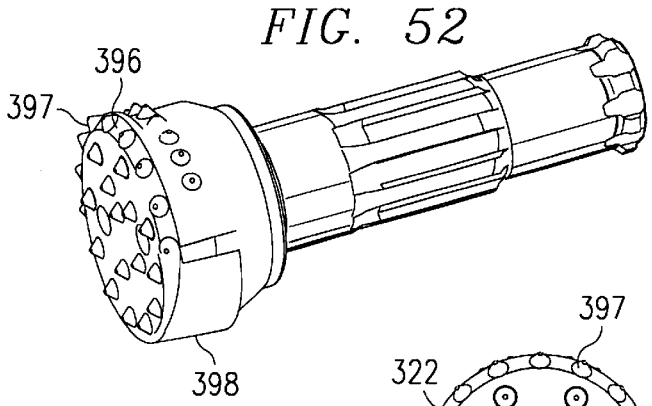
FIG. 52 is a side perspective view of the bit and bit shaft assembly of FIG. 51.
Figure 53:
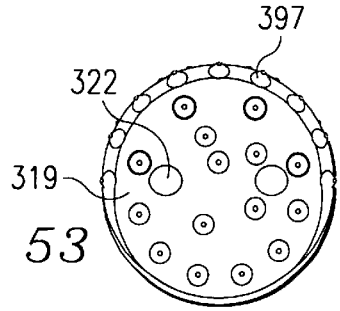
FIG. 53 is a front view of the bit of FIG. 52.
Figure 54:
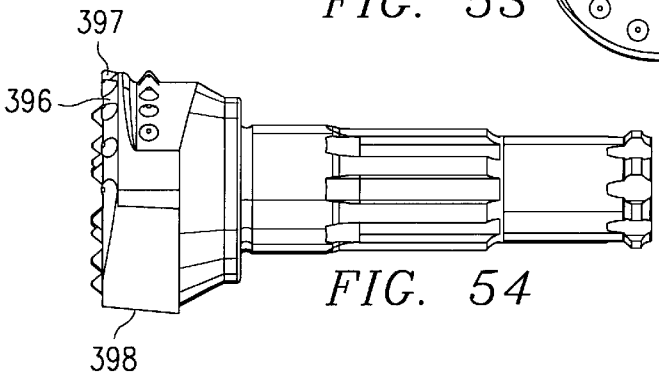
FIG. 54 is a side view of the bit and bit shaft assembly of FIG. 52.
Figure 55:
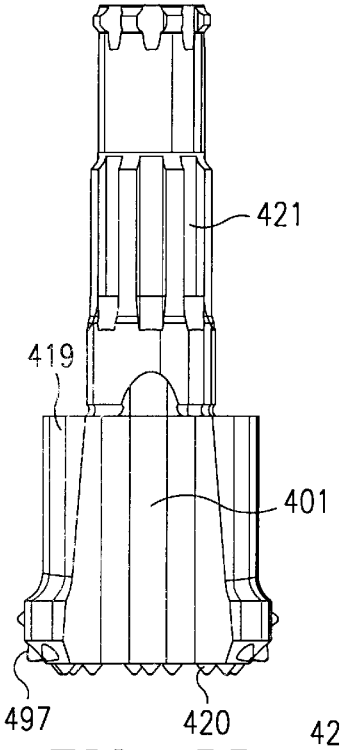
FIG. 55 is a top view of a third alternative bit and bit shaft assembly according to the invention.
Figure 56:
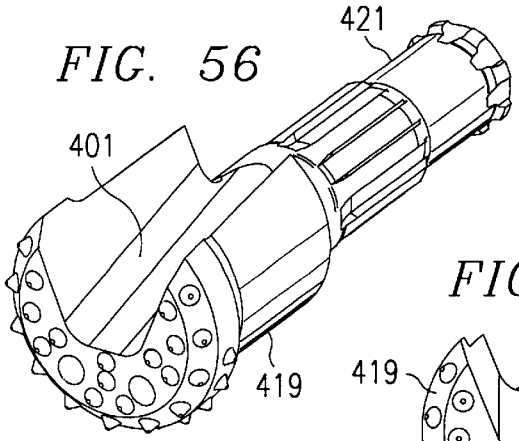
FIG. 56 is a side perspective view of the bit and bit shaft assembly of FIG. 55.
Figure 57:
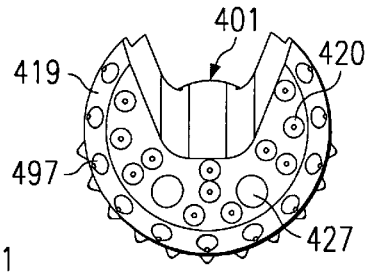
FIG. 57 is a front view of the bit of FIG. 55.
Figure 58:
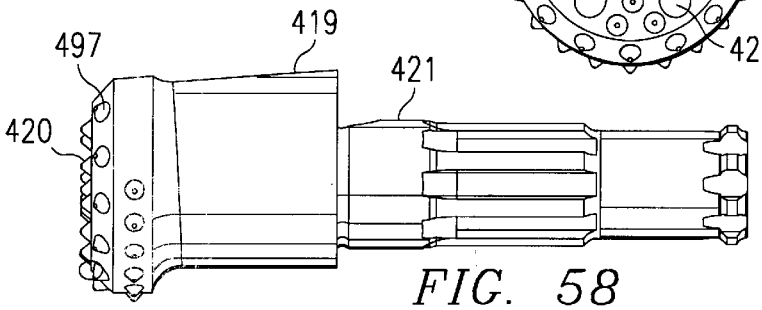
FIG. 58 is a side view of the bit and bit shaft assembly of FIG. 55.
Figure 59:
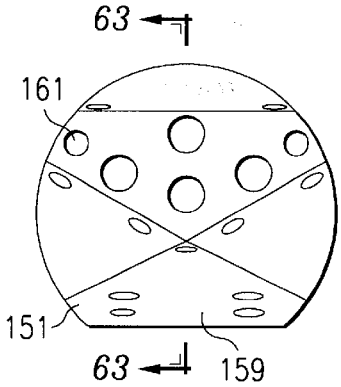
FIG. 59 is a front view of a bit for boring through dirt according to the invention.
Figure 60:
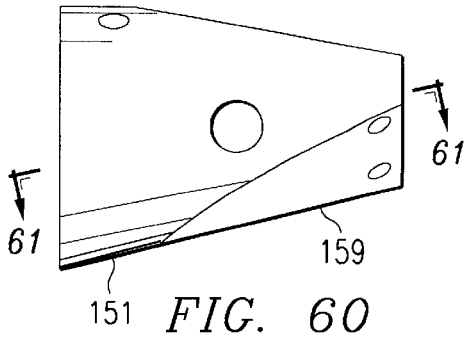
FIG. 60 is a side view of the bit of FIG. 59.
Figure 61:
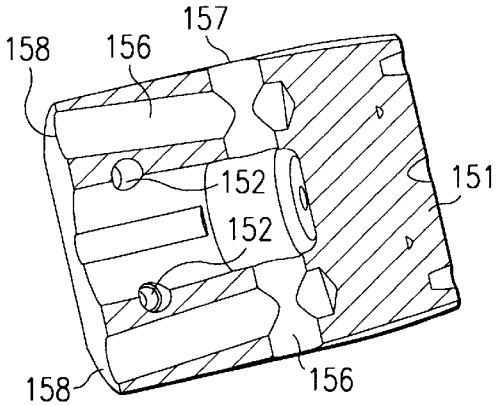
FIG. 61 is a sectional view taken along the line 61—61 in FIG. 60.
Figure 62:
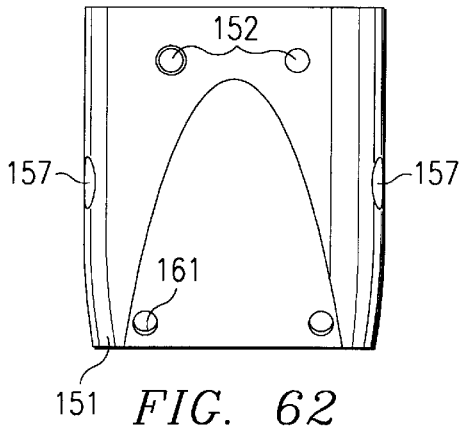
FIG. 62 is a bottom view of the bit of FIG. 59.
Figure 63:
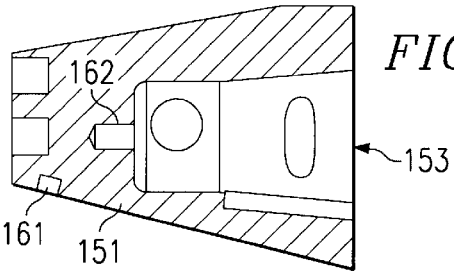
FIG. 63 is a sectional view taken along the line 63—63 in FIG. 59.
Figure 64:
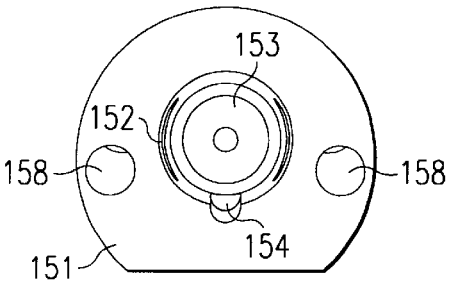
FIG. 64 is a rear view of the bit of FIG. 59.
Figure 65:
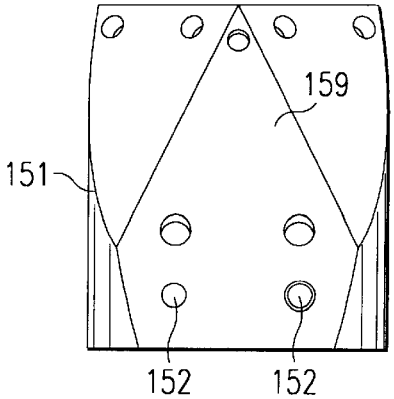
FIG. 65 is a top view of the bit of FIG. 59.

FIGS. 46–58 illustrate several variations and styles of bits 119, 219, 319, 419. that can be used in the present invention. As discussed hereafter, the heel 98 can be a relatively large sloped surface 298 or a very slight taper from rear to front (see the surface of heel 198), depending on the manner in which the tool is to be operated. Similarly, the gage tower may protrude a substantial distance (96, 196, 296) or only slightly (396), or not at all if the bit has an suitably asymmetrical shape. In FIGS. 55–58, a sloped trough 401 for carrying away soil and cuttings is provided. In FIGS. 48–50, each ejection port 127 including the middle pair further includes a shallow, generally radial groove 102 that extends from the port 127 and carries the foam to the outer periphery of the bit 119. Each of these embodiments have proven successful in boring, although the bits 119 and 219 have proven most effective for conditions involving steering in both soil and rock. Bits 55–58 have an integral (or affixed) bit shaft 421 that is configured for use with a known Halco impact hammer.

The present invention allows a pipe or cable to be placed below the surface in solid rock conditions at a desired depth and along a path that can curve or contain changes in direction. The process described allows the operator to start at the surface or in a small excavated pit, drill rapidly through the rock with the aid of the fluid (pneumatic, mud or water) actuated percussion hammer 16, and make gentle steering direction changes in any plane. The operator can thus maintain a desired depth, follow a curving utility right of way or maneuver between other existing buried utilities that may cross the desired path.

Figure 46:
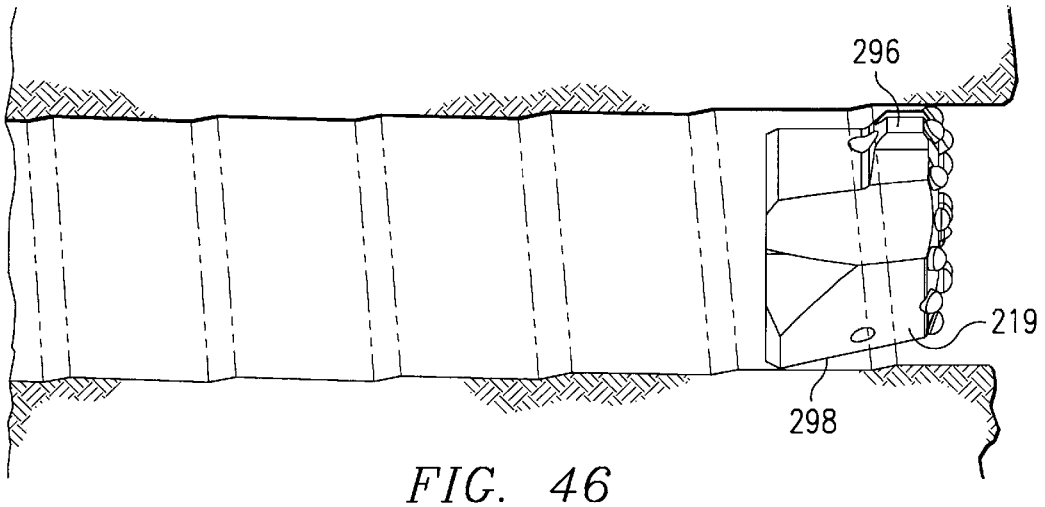
FIG. 46 is a side view of a fourth alternative bit according to the invention, with the rest of the tool omitted, showing the steering action in rock.
Figure 47:
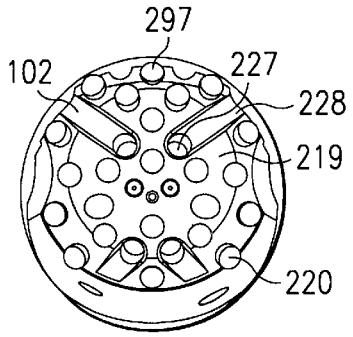
FIG. 47 is a front view of the bit of FIG. 46.

One innovation lies specifically in the interaction between the shape of the bit during the percussive cutting process and the motion of the drill string which couples the directional boring machine to the hammer. Motion relative to the features on the bit is important. The bits 119, 219 shown in FIGS. 46–50 does not rely on an inclined steer plane, slope or angle to cause a direction change when drilling. Direction change is accomplished due to the non-symmetrical bore hole shape created when bit 119, 219 is impacted and rotated at constant angular velocity through a consistent angle of rotation and in a cyclic manner about the drill string, the angle being less than a full revolution, producing a progressive change in direction as shown in FIG. 46.

The rotation velocity must be approximately constant to allow the carbide percussion cutters 20, 120, 220 and 97, 197, 297 to penetrate the entire bore face. The angle of rotation must be less than a full revolution so that the bore hole will be non-symmetrical. The angle traversed must be consistent for a multitude of cycles as the penetration per cycle will be limited, perhaps 0.05 to 0.25 per cycle depending on rock conditions and rotational velocity. The angle must be greater than zero or no cutting will take place, it is typically over 45 degrees up to 240 degrees, with the range of 180 to 240 providing the best results. The center point of the angular sweep must be kept consistent to induce a direction change.

The bore created will be non-symmetrical because the bit shape when considering the gage tower is non-symmetrical and it is not fully rotated about the drill string axis. Having bored for some distance using the actions described and for a multitude of cycles, the non-symmetrical bore will induce a gradual direction change (see, e.g., FIG. 46). The bore is larger than the drill head 10 or drill string, allowing the drill head axis and hence the bit to be angularly inclined relative to the bore axis. Space between the drill head and the bore wall allows the drill head 10 to be tipped or repositioned in the bore by induced drilling forces. Existence of the gage tower 96 makes the center of pressure on the bit face move from the drill head central axis (where non-steerable hammers have it) to some point closer to the gage cutters 97. The static thrust and mass act along the drill head axis. The reaction force from the percussive cutting action is significant, with peak forces easily reaching 50,000 LB for a period of several milliseconds per impact.

With the impact reaction force being along a different axis than the hammer mass and thrust, a moment (torque) is induced that will bend the drill head 10 and drill string within the clearance of the bore. The drill head will tend to rotate away from the gage tower. This action points that drill head in a new direction and causes the bore to progress along that axis. The axis is continually changing, which creates a curved bore path.

As noted above, to avoid creating a round, symmetrical bore during the steering operation, the bit 19, 119, 219 must not cut for the entire revolution. To make this a cyclic process, the operator can either rotate in the opposite direction when the angular limit has been reached, or pull back off the face and continue rotation around until the start point is reached. A third alternative is to pull back off the face and rotate in the opposite direction to the start point. All three methods have been used successfully, but the third method may cause difficulty if a small angle of rotation is being used and the hole is highly non-symmetrical. In this case, the bit can't be rotated and may become stuck.

The predominant feature in all of the bits 19 shown that have been successful is the existence of gage cutters 97 mounted on a gage tower 96. Whether the bit has an inclined heel or wedge 98, 198, 298 designed into it or not, the gage tower must be present for the drill head 10 to steer successfully in solid rock. Drill head 10 will steer in granular, unconsolidated material such as soil without a gage tower but with a wedge. It will also steer in granular soil without a wedge, but with a gage tower. It steers fastest in soil with both features.

Placement of the mass in the hammer/sonde housing assembly is also important. To place the mass centroid biased to the gage tower side of the hammer axis would be deleterious. To place it on center is acceptable. To place it biased away from the gage tower is advantageous. The reaction of the off center mass will enhance the desired deflection of the hammer, thereby increasing the maximum rate of steer that can be achieved. Since the hammer 16 is essentially symmetrical in its mass distribution, the center of mass of the drill head 10 can be most readily adjusted by offsetting the sonde holder 14 and optionally the starter rod 12 away from the gage tower to shift the center of mass of drill head 10 in a favorable direction. Sonde holder 14 discussed above does this and achieves better air flow as an additional benefit.

Rotation angle effects the rate of steering. Smaller rotation angles create a more eccentric bore shape and increase the rate of steering. However, small rotation angles also create smaller bores than large rotation angles and can make it difficult to pull the hammer backwards out of the bore.

In general, more eccentric bit designs will steer faster than less eccentric designs. The limit to eccentricity is the challenge created by passing the bending moment from the slidable bit shaft to the hammer body. A more eccentric bit has a large moment and increased potential for galling on the sliding joint. The existence of this moment resulted in incorporating a wide bearing surface on the bit shaft splines as well as a secondary bearing behind the splines.

The drill head of the invention is unique in that the operator can cause the bore path to deviate at will (or go straight) despite the difficulties that solid rock presents when compared to compressible material such as soil. A combination of motions produces either steering or straight boring. The operating characteristics of the hammer combined with the geometry of the head are utilized along with various rotational motions to direct the hammer.

Boring straight is the easiest of the directions to achieve. With compressed air supplied through the drill string in the range of 80–350 psi, a thrust force is applied to the hammer. The thrust force reacts against the face of the hammer and counteracts the pneumatic force that has extended the reciprocating head. The hammer and drill string must travel forward, compressing the head approx. ½ to 1" toward the hammer. This change in position of the head relative to the hammer shifts internal valving and starts the tool impacting. Typically only slightly more pressure is applied to the hammer than it takes to get it started.

To bore straight, the operator rotates the drill continuously about the drill string axis. Speed is typically from 5 to 200 RPM. Maximum productivity is a function of hammer rate, usually from 500 to 1200 impacts/minute as well as rotation speed. The ideal rate is that which causes the tungsten carbide buttons to sequentially impact half of their diameter (typical button dia. being ½") away (tangentially) from the previous impact. In this example, a 6" diameter bore hole created by a hammer with 700 impacts per minute should rotate at per the calculations shown: button dia=0.50", half button dia=0.25", circumference=6.0"*π=18.84", rotation per impact=0.25"/18.84"*360 deg=4.78 degrees, degrees*700 impacts/minute=3346 deg/min, 3346/360=9.3 RPM. Most often the speed is higher than this. When the button pattern center is eccentric to the drill head center, a round hole is cut about the theoretical cut axis. This axis is located midway between the outermost gage cutter and the bottom of the steer plane (heel).

Boring an arc (steering) requires a more sophisticated motion than going straight. This explanation assumes steering upwards from a nominally horizontal bore axis. Any direction can be achieved by reorienting the midpoint of the steering motion. To steer up, the gage cutters must be oriented at the top, and the steer plane or heel is located at the bottom. Imagining the face of a clock placed on the front of the bore face, the operator starts with the gage buttons at 8 o'clock. The drill string is thrust into the bore face thereby actuating the hammer. Once running, the drill string is rotated clockwise at a rate preferably matching the ideal rate for boring straight. This rotation continues for 8 hours of the clock face until the gage buttons reach 4 o'clock. At that point the hammer is retracted far enough to pull the buttons off the face of the bore, thereby stopping the hammer. The drill string is rotated counterclockwise to 8 o'clock and the process is repeated, or one of the other methods for returning to the starting point described above may be used.

This method, know as shelving, will cut a shape that is approximately circular, but with a sliver of rock remaining on the bottom. That sliver is the shelf. The process is repeated many times, progress per 4 hour clock cycle (e.g., cutting from 10 to 2) may be 0.20". With a cycle rate of 30 times/minute, progress would be 6"/minute. The bore profile with the semi-circular face continues to cut straight until the steer plane (cone) contacts the shelf. This sliver of shelf forces the profile to raise as continued progress is made. The sliver as shown in a 6" bore has a height of 0.12". The steer plane, in one embodiment represented by surface 298 at 12 degrees of angle off the axis rides this sliver or shelf upwards 0.12" over approximately 0.57" of forward travel. The bit again cuts straight with its semi-circular profile for a distance of approximately 2.5" until the steer plane again contacts the shelf. However, due to the relatively long inclined surface, the back bit 219 can become stuck in hard rock formations and is thus preferred for drilling in softer rock. Bit 119 with only a slight forward taper along its heel is more suited for hard rock drilling. As stated above, it has also been found that a bit with no angle or taper is also capable of riding up a succession of shelves, as long as there is some radial offset between the bottom edge of the bit at heel 98, 198 and the lowest carbide 20, 120, 220 positioned opposite the gage tower; see, e.g., the distance D between lowest carbide 220A in FIG. 49 and the outermost edge of heel 198.

This process is a stair step operation with tapered risers ad straight steps of the kind shown in FIG. 46. The action of the shelf not only changes the elevation of the drill head, but also helps it to change angular inclination. The rear of the drill string (approximately 30" to the rear of the face) acts as a fulcrum or pivot point. Raising the front of the hammer without raising the rear causes it to tip up. With enough change in direction, the operator can now bore straight having made the steering correction. The drill head changes direction by 3 degrees in only 32" of travel, a figure that would be acceptable even in compressible media.

The foregoing steering method is most effective in rock but may also be used in soil or other loose media. In addition, steering in soil may also be accomplished using the technique of stopping rotation of the bit and relying on the heel area on the side of the bit to cause deviation in the desired direction. As noted above, it is most effective to continue running the hammer when steering in this fashion.

Because the disruption created by the process of the invention is minimal, the expense involved in restoring the job site is often minimal. A bore can be created beneath a multi-lane divided highway while the road is in use, even if solid rock is encountered during the bore. No disruption or traffic control is needed as the equipment can be set back from the highway's edge, no explosives are used, the drill head location is tracked constantly during drilling and no heavy equipment needs to cross to the opposite side of the road. The bore can be started at the surface and may be completed by exiting the rock surface at the target point.

In addition, if it is necessary to travel through sand or soil in order to reach the rock formation, the drill head of the invention permits steering under such conditions. However, to improve the rate of steering in sand or soil without having to remove the hammer, a soil bit such as the one shown in FIGS. 59–65 may be used until rock is encountered, whereon the drill head is withdrawn and bit changed to one of the ones discussed above suitable for drilling and steering in rock. Such a soil bit 151 includes a steel bit body having a pair of transverse holes 152 configured for interchangeability with holes 23 of bit 19 and a similarly configured rear recess 153 that fits closely onto the front end portion of bit shaft 21, including a groove 154 for receiving drive key 30. A pair of passages 156 in the sidewalls of recess 153 conduct the pressure fluid (drilling mud, foam, water, air, etc.) straight to a pair of laterally facing outlet ports 157 and rearwardly facing outlet ports 158. A sloped face 159 defines an acute included angle (e.g., 10–60°) relative to the lengthwise axis of bit 151 permits steering in soil by the well known push to steer, push and rotate to bore straight method. Carbide body studs may be omitted, or if desired carbides can be mounted on the front and sides of the bit in holes 161 to improve durability. Additional holes may be formed as needed to aid in manufacture (e.g., central hole 162.) Such a soil bit may be used at the start of a project until rock is encountered, whereon the drill is withdrawn from the hole and one of the rock drilling bits is installed in place of the soil bit.

While certain embodiments of the invention have been illustrated for the purposes of this disclosure, numerous changes in the method and apparatus of the invention presented herein may be made by those skilled in the art, such changes being embodied within the scope and spirit of the present invention as defined in the appended claims.

What is claimed is:

1. In a drill head for an apparatus for directional boring including a bit, a holder for a device for detecting angular orientation of the bit, and a pneumatic hammer connected head to tail with the bit at a front end, wherein the improvement comprises a valve in the hammer that initiates reciprocation of the hammer in response to rearward movement of the bit when the hammer is connected to a drill string supplying a pressure fluid.

2. A drill head for an apparatus for directional boring, comprising:

a bit configured for directional boring, which bit can be steered by cutting over a limited arc of rotation with a predetermined cutting surface of the bit;

a holder for a device for detecting angular orientation of the bit, including a key that permits mounting of the device in a predetermined position;

a hammer positioned to deliver impacts to the bit, wherein the holder, hammer and bit are connected in series head to tail to form the drill head;

a connection suitable for mounting the drill head to a drill string; and a series of keying connections between the holder, hammer and bit which key the angular orientation of the cutting surface of the bit to the angular orientation of the key of the holder, such that each connection fits together only when its angular orientation is keyed to the key of the holder.

3. The drill head of claim 2, wherein the keying connections comprise a plurality of spline and groove connections.

4. The drill head of claim 3, wherein each set of spline and groove connections includes a master spline and a master groove having a different size from at least one other spline and groove of that connection.

5. The drill head connection of claim 4, wherein a first one of the keying connections is at a front end portion of the holder and a read end portion of the hammer, a second one of the keying connections is between a housing of the hammer and a sleeve that fits into a front end opening of the housing, and a third one of the keying connections is between the sleeve that fits into a front end opening of the housing and a bit shaft slidably mounted in the sleeve.

6. The tubular housing of claim 3, wherein each set of spline and groove connections includes a master spline and a master groove having having a different size from at least one other spline and groove of that connection.

7. A tubular housing configured for use in a drill head for an apparatus for directional boring, which drill head includes as components a bit configured for directional boring, which bit can be steered by cutting over a limited arc of rotation with a predetermined cutting surface of the bit, and one or more of a holder for a device for detecting angular orientation of the bit, including a key that permits mounting of the device in a predetermined position, a hammer positioned to deliver impacts to the bit, and a starter rod that connects the drill head to a drill string, wherein the drill head components are connected in series head to tail to form the drill head, a connection suitable for mounting the drill head to a drill string, and a series of keying connections between the holder, hammer and bit which key the angular orientation of the cutting surface of the bit to the angular orientation of the key of the holder, wherein the housing has a front end portion configured to form a first keying connection at a front end thereof and a second end portion configured to form a second keying connection at a rear end thereof.

8. The tubular housing of claim 7, wherein the first and second keying connections comprise a plurality of longitudinal spline and groove connections.

9. The tubular housing of claim 7, wherein the tubular housing is configured to house the hammer.

10. A rock drilling bit assembly, comprising:

a drill bit including a bit body, a front drilling surface having a plurality of cutting teeth extending therefrom, a rearwardly opening recess, and a transverse hole intersecting the rearwardly opening recess; and a bit shaft having a front end portion configured for a close fit into the recess of the drill bit and having an outwardly opening transverse groove which comes into alignment with the transverse hole in the drill bit for receiving a retainer therein.

11. The bit assembly of claim 10, wherein the bit shaft has an enlarged diameter rear portion configured for sliding, sealing engagement inside of a tubular sleeve.

12. The bit assembly of claim 11, wherein the bit shaft has a series of external, longitudinal splines thereon ahead of the rear portion and configured for sliding engagement with grooves in a member in which the bit shaft is mounted.

13. The bit assembly of claim 12, wherein one of the bit shaft splines is a master spline having a different size that at least one other spline.

14. The bit assembly of claim 10, further extending a forwardly extending, longitudinal groove in the outer surface of the front end portion of the bit shaft, and a separate drive key which fits within the forwardly extending, longitudinal groove.

15. The bit assembly of claim 10, wherein the cutters comprises spaced carbide studs.

16. A drill head for an apparatus for directional boring, comprising:

a bit configured for directional boring, which bit can be steered by cutting over a limited arc of rotation with a predetermined cutting surface of the bit;

a holder for a device for detecting angular orientation of the bit, including a key that permits mounting of the device in a predetermined position;

a hammer positioned to deliver impacts to the bit, wherein the holder, hammer and bit are connected in series head to tail to form the drill head;

a connection suitable for mounting the drill head to a drill string; and key of the holder;

wherein a mass centroid of the drill head is located on an opposite side of a lengthwise axis of the drill head from the predetermined cutting surface of the bit.

17. The drill head of claim 16, wherein the holder is asymmetrical and a portion of the holder's mass causes the mass centroid of the drill bit to be located on an opposite side of a lengthwise axis of the drill head from the predetermined cutting surface of the bit.

18. The drill bit of claim 17, wherein the hammer is interposed between the bit and the holder, whereby the predetermined cutting surface of the bit is diametrically opposed to a laterally projecting portion of the holder.

19. A sonde holder for use in a drill head including at least a bit, the sonde housing and a connection at a rear end of the drill bit for connecting the drill head to a drill string, comprising:

a cylindrical housing having front and rear end connecting portions configured for coupling the sonde holder into the drill head assembly, which front and rear connecting portions are in alignment with a longitudinal axis of the sonde housing which coincides with a longitudinal axis of the drill head;

a flow passage for passing compressed fluid from rear to front in the sonde holder; and a sonde compartment suitable for containing a sonde in a keyed position, which compartment is isolated from the flow passage and laterally offset therefrom;

wherein the cylindrical housing including a portion thereof defining the sonde compartment projects laterally from the longitudinal axis of the sonde housing which coincides with the longitudinal axis of the drill head, whereby the mass centroid of the sonde holder is offset from the a longitudinal axis of the sonde housing which coincides with the longitudinal axis of the drill head.

20. The sonde holder of claim 19, further comprising a removable cover for closing the sonde compartment, which cover is laterally offset from the longitudinal axis of the sonde housing which coincides with the longitudinal axis of the drill head and contributes to the offset of the mass centroid of the sonde holder.

21. The sonde holder of claim 20, further comprising a shoulder adjacent one end of the sonde cover that projects laterally away from the longitudinal axis of the sonde housing which coincides with the longitudinal axis of the drill head and contributes to the offset of the mass centroid of the sonde holder.

22. The sonde holder of claim 19, further comprising front and rear sockets at opposite ends of the flow passage configured for forming sealed connections with adjoining drill head components.

23. A bit for use in directional drilling, comprising a bit body having a frontwardly facing sloped face that defines an acute included angle relative to a lengthwise axis of the bit and configured for steering the bit through dirt when a pushing force is applied to the bit without rotating the bit;

a rearwardly opening recess for mounting the bit onto a bit shaft;

at least one transverse hole intersecting the rearwardly opening recess and configured for insertion of a retaining pin therein which can mechanically interlock the bit to the bit shaft; and a fluid passage configured to carry pressure fluid from the recess to a location away from a front end of the bit.

24. The bit of claim 23, wherein the fluid passage opens on a rear wall of the bit outside of the recess.

* * * * *